US007460815B2

(12) United States Patent
Kamoshida et al.

(10) Patent No.: US 7,460,815 B2
(45) Date of Patent: Dec. 2, 2008

(54) CHARGE ROLLER FOR NONCONTACT CHARGING ACROSS A CHARGE GAP, METHOD FOR PRODUCING THE SAME, AND IMAGE-FORMING APPARATUS INCLUDING THE SAME

(75) Inventors: Shinichi Kamoshida, Suwa (JP); Katsunori Ono, Shiojiri (JP); Tadahiro Mizutani, Shiojiri (JP); Kazuyoshi Ohashi, Matsumoto (JP); Masaru Kobashi, Suwa (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 11/586,823

(22) Filed: Oct. 26, 2006

(65) Prior Publication Data

US 2007/0092298 A1 Apr. 26, 2007

(30) Foreign Application Priority Data

Oct. 26, 2005 (JP) ..... 2005-310809

(51) Int. Cl.
*G03G 15/02* (2006.01)

(52) U.S. Cl. ..... 399/176

(58) Field of Classification Search ..... 399/168, 399/115, 174, 176
See application file for complete search history.

(56) References Cited

U.S. PATENT DOCUMENTS 7,366,447 B2 * 4/2008 Mukai et al. ..... 399/168
2007/0025766 A1 * 2/2007 Kamoshida et al. ..... 399/159

FOREIGN PATENT DOCUMENTS

JP 2001-296723 10/2001

* cited by examiner

*Primary Examiner*—Quana M Grainger
(74) *Attorney, Agent, or Firm*—Hogan & Hartson LLP

(57) ABSTRACT

A charge roller includes a core, a resistive layer disposed on a circumferential surface of the core to charge an image-bearing member without contact, and gap members formed of tape-shaped films. These films are fixed to both ends of the charge roller by winding each of the films in a direction opposite a rotational direction of the charge roller in use and perpendicular to the axial direction thereof to form n layers (wherein n≧2) extending in the axial direction at every position in the circumferential direction of the charge roller. The gap members are pressed against a circumferential surface of an image-bearing member to define a charge gap between the image-bearing member and the charge roller.

9 Claims, 14 Drawing Sheets

CHARGE ROLLER FOR NONCONTACT CHARGING ACROSS A CHARGE GAP, METHOD FOR PRODUCING THE SAME, AND IMAGE-FORMING APPARATUS INCLUDING THE SAME

BACKGROUND

1. Technical Field

The present invention relates to the technical field of a charge roller, a method for producing the charge roller, and an electrophotographic apparatus including the charge roller, such as an electrostatic copier, a printer, or a facsimile. The charge roller includes gap members formed of tape-shaped films fixed to the roller by winding them around both ends of the roller to define a predetermined charge gap for noncontact charging between the roller and an image-bearing member.

2. Related Art

JP-A-2001-296723, for example, discloses an image-forming apparatus that defines a predetermined charge gap between a charge roller and an image-bearing member to charge the image-bearing member without contact. Referring to FIG. 14A, a charge roller 14*a* included in the image-forming apparatus disclosed in this publication includes a core 14*b*, a resistive layer 14*c* disposed on the circumferential surface of the core 14*b* and formed of a conductive elastic material, and a pair of annular gap members 14*d* and 14*e* fixed to the resistive layer 14*c* by winding them around both ends of the circumferential surface of the resistive layer 14*c* and formed of insulating tape-shaped films. A predetermined charge gap G is defined by bringing the pair of gap members 14*d* and 14*e* into contact with the circumferential surface of a photosensitive drum 14*f* serving as an image-bearing member. Rotating shafts 14*g* and 14*h* protrude coaxially from end surfaces of the core 14*b* in the axial direction thereof. The rotating shafts 14*g* and 14*h* are supported by bearings 14*i* and 14*j*, respectively. Compression springs 14*k* and 14*m* urge the bearings 14*i* and 14*j*, respectively, against the photosensitive drum 14*f* to bring the gap members 14*d* and 14*e* into contact with the circumferential surface of the photosensitive drum 14*f*.

When the charge roller 14*a* charges the photosensitive drum 14*f* without contact across the charge gap G, the charge gap G can prevent generation of ozone, adhesion of foreign matter such as toner from the photosensitive drum 14*f* to the charge roller 14*a*, and adhesion of substances contained in the resistive layer 14*c* to the photosensitive drum 14*f*. The charge roller 14*a* can thus charge the photosensitive drum 14*f* with higher charge performance.

When a tape-shaped film is wound around a charge roller, a seam is left between both ends of the film in the circumferential direction. The charge roller must be rotated with a uniform charge gap maintained at any position in the circumferential direction so that the roller can constantly perform stable, excellent charging. To meet the requirement, the film must be wound around the charge roller with no gap or overlapping portion (overlapping in the radial direction of the charge roller 14*a*) left at the seam between both ends of the film (in the circumferential direction of the charge roller). To wind the film around the charge roller in such a manner, however, the length of the film must be defined with high accuracy, and the film must also be wound around the charge roller with high accuracy. Consequently, the dimensions of the film must be extremely strictly controlled, and thus low productivity and high cost result.

If the dimensional accuracy and winding accuracy of the film are lowered for improved productivity and cost reduction, a gap or an overlapping portion inevitably occurs at the seam between both ends of a gap member formed by winding the film around the charge roller by substantially one turn. Such a condition can result in the absence of the gap member at the seam or a variation in the thickness thereof, and thus the charge gap can vary when the seam reaches the nip (contact position) between the gap member and an image-bearing member. In that case, the charge roller fails to constantly perform stable, excellent charging.

For the charge roller 14*a* disclosed in the publication above, as shown in FIGS. 14B and 14C, both ends $\mathbf{14}d_1$ and $\mathbf{14}d_2$ of the film of the gap member 14*d* are cut obliquely, and the film is wound around the charge roller 14*a* with a gap 14*s* left at the seam between the ends $\mathbf{14}d_1$ and $\mathbf{14}d_2$. The film can thus be wound around the charge roller 14*a* so that the gap member 14*d* extends in the axial direction at every position in the circumferential direction of the charge roller 14*a*. Even though the seam is left, accordingly, a constant charge gap G can be maintained without extremely strict control of the dimensions of the film. Although not illustrated, the film of the other gap member 14*e* is similar to the film of the gap member 14*d*.

Referring to FIGS. 14D and 14E, the film of the gap member 14*d* may also be spirally wound around the charge roller 14*a* by a length that is larger than two turns by a predetermined length. The film is shifted for each turn in the axial direction of the charge roller 14*a* without overlapping in the radial direction thereof, and the end $\mathbf{14}d_2$ is shifted from the end $\mathbf{14}d_1$ in the axial direction. Thus, the gap member 14*d* extends in the axial direction at every position in the circumferential direction of the charge roller 14*a*. Such spiral winding leaves no seam between the ends $\mathbf{14}d_1$ and $\mathbf{14}d_2$ because the film is wound around the charge roller 14*a* by a length that is larger than two turns by a predetermined length such that the film is shifted in the axial direction for each turn. Accordingly, a constant charge gap G can be maintained without extremely strict control of the dimensions of the film. Although not illustrated, the film of the other gap member 14*e* is similar to the film of the gap member 14*d*.

It should be noted that, although not described here, the publication above also discloses other methods for forming gap members extending in the axial direction at every position in the circumferential direction of the charge roller 14*a*.

If, however, the film of the gap member 14*d* is simply wound around the circumferential surface of the charge roller 14*a*, the ends $\mathbf{14}d_1$ and $\mathbf{14}d_2$ of the film are exposed and come into contact with the photosensitive drum 14*f* either in the case of FIG. 14B or in the case of FIG. 14D. In FIGS. 14C and 14E, the ends $\mathbf{14}d_1$ and $\mathbf{14}d_2$ repeatedly come into contact with the photosensitive drum 14*f* when the charge roller 14*a* rotates clockwise. The photosensitive drum 14*f* then repeatedly exerts a force on the film at the nip between the charge roller 14*a* and the photosensitive drum 14*f* so as to peel the end of the film at which it starts entering the nip. This force undesirably peels the film off the charge roller 14*a* and curls it up. In particular, the gap member 14*d* can peel more frequently if the charge roller 14*a* is formed of an inelastic material.

In addition, foreign matter such as toner particles intrudes the gap 14*s* of the seam between the ends $\mathbf{14}d_1$ and $\mathbf{14}d_2$ of the film and adheres to the film during image-forming operation. Such foreign matter deteriorates the adhesion between the ends $\mathbf{14}d_1$ and $\mathbf{14}d_2$ of the film and the charge roller 14*a*, and thus promotes peeling of the film at the ends $\mathbf{14}d_1$ and $\mathbf{14}d_2$ thereof. The same holds true for the film of the other gap member 14*e*.

If the ends of the gap members 14*d* and 14*e* are curled, the charge gap G varies when the charge roller 14*a* rotates, and thus the gap members 14*d* and 14*e* fail to maintain a constant charge gap G. This makes it difficult to perform uniform, stable, excellent charging of the photosensitive drum 14*f*.

If the film is wound in layers to form the gap members 14*d* and 14*e*, the photosensitive drum 14*f* suffers from discharge during noncontact charging using a superimposed bias voltage containing DC and AC voltage components. The discharge undesirably decreases the thickness of a charged portion of the photosensitive drum 14*f* with increasing number of prints. The problem of decreased thickness makes it difficult to control the charge gap G to a predetermined width or less or successfully charge the photosensitive drum 14*f*.

SUMMARY

An advantage of some aspects of the invention is that they provide a charge roller capable of preventing peeling of tape-shaped gap members fixed to both ends thereof over an extended period of time to perform stable, excellent noncontact charging across a predetermined charge gap defined by bringing the gap members into contact with an image-bearing member, and also provide a method for producing the charge roller and an image-forming apparatus including the charge roller.

Another advantage of some aspects of the invention is that they provide a charge roller capable of preventing peeling of seamed, tape-shaped gap members fixed to both ends thereof over an extended period of time and performing stable, excellent noncontact charging across a predetermined charge gap defined by bringing the gap members into contact with an image-bearing member even if the thickness of a charge portion of the image-bearing member is decreased, and also provide a method for producing the charge roller and an image-forming apparatus including the charge roller.

A charge roller according to an aspect of the invention includes a core, a resistive layer disposed on a circumferential surface of the core to charge an image-bearing member without contact, and gap members formed of tape-shaped films. These films are fixed to both ends of the charge roller by winding each of the films in a direction opposite a rotational direction of the charge roller in use and perpendicular to the axial direction thereof to form n layers (wherein $n \geqq 2$) extending in the axial direction at every position in the circumferential direction of the charge roller. The gap members are pressed against a circumferential surface of an image-bearing member to define a charge gap between the image-bearing member and the charge roller.

The n layers of each film extend in the axial direction at every position in the circumferential direction of the charge roller so as to have a uniform thickness. An end of the film at which it starts entering a contact position (nip) between the charge roller and the image-bearing member is covered by the overlying layers of the film so as not to come into contact with the image-bearing member when entering the contact position. This prevents the peeling of the gap members off the charge roller after extended image-forming operation (printing operation). In particular, the peeling of the gap members can be prevented more effectively by forming the resistive layer with a material having a relatively low elastic coefficient, such as a conductive rubber, so that the resistive layer can readily be elastically deformed by a pressure applied at the contact position between the charge roller and the photosensitive member.

In addition, little foreign matter such as toner particles adheres to the ends of the gap members because they are seamless. In particular, the end of each film at which it starts entering the contact position can be covered and protected by the overlying layers of the film to prevent the peeling of the end of film more effectively. The gap members can therefore maintain a uniform, stable charge gap to perform excellent charging of the image-bearing member for high-quality image formation over an extended period of time.

Furthermore, a uniform, stable charge gap can readily be defined over an extended period of time without peeling of the films simply by winding them to form the n layers.

In the charge roller, both ends of each of the films may be cut in parallel obliquely with respect to the longitudinal direction thereof.

It is preferable that the core has annular grooves at both ends thereof, the resistive layer is disposed on a portion of the core between the annular grooves and in the annular grooves, and the gap members are fixed to portions of the circumferential surface of the core between the annular grooves and the ends of the core.

The annular grooves formed on the core can inhibit intrusion of toner into the bottom sides of the ends of the films to prevent the peeling of the ends of the films over an extended period of time.

Preferably, one side of each of the films protrudes to the adjacent annular groove, and the other side of the film protrudes outward beyond the adjacent end surface of the core.

These protrusions can prevent abnormal discharge (leakage of charge) between exposed portions of the core and the image-bearing member.

A method for producing the charge roller includes forming the annular grooves at both ends of the core; covering with masks the portions of the circumferential surface of the core between the annular grooves and the ends of the core; forming the resistive layer by applying a conductive coating material to the annular grooves and the portion of the core between the annular grooves while rotating the core; removing the masks from the portions of the circumferential surface of the core between the annular grooves and the ends of the core; and forming the gap members by winding the films around the portions of the circumferential surface of the core between the annular grooves and the ends of the core in the direction opposite the rotational direction of the charge roller in use and perpendicular to the axial direction of the charge roller to form the n layers.

According to the method for producing the charge roller, the portions of the core where the gap members are to be fixed are covered with the masks, and the conductive coating material is applied to the exposed portion of the circumferential surface of the core with the charge roller being rotated. The resistive layer can thus be uniformly formed on the circumferential surface of the core. Without the annular grooves, the boundaries (edges) of the resistive layer are difficult to reliably define by applying the conductive coating material. The annular grooves allow reliable definition of the boundaries of the resistive layer and more uniform application of the conductive coating material to the circumferential surface of the core.

It is preferable that the resistive layer includes thinner portions at both ends of the core and a thicker portion between the ends of the core, and the gap members are fixed to the thinner portions of the resistive layer.

A method for producing such a charge roller includes covering both end portions of the circumferential surface of the core with masks; forming the thicker portion of the resistive layer by applying a conductive coating material to a portion between the end portions of the circumferential surface of the core to a predetermined thickness while rotating the core;

removing the masks from the end portions of the circumferential surface of the core; forming the thinner portions of the resistive layer by applying the conductive coating material to both ends of the core to a thickness smaller than that of the thicker portion; and forming the gap members by winding the films around the thinner portions of the resistive layer in the direction opposite the rotational direction of the charge roller in use and perpendicular to the axial direction of the charge roller to form the n layers.

It is also preferable that the core includes small-diameter portions at both ends thereof and a large-diameter portion between the ends thereof, the resistive layer is formed on circumferential surfaces of the small-diameter portions and the large-diameter portion so as to have a substantially uniform thickness, and the gap members are fixed to portions of the resistive layer which cover the small-diameter portions of the core.

A method for producing such a charge roller includes forming the resistive layer by applying a conductive coating material to the small-diameter and large-diameter portions of the core to a predetermined thickness while rotating the core; and forming the gap members by winding the films around the portions of the resistive layer which cover the small-diameter portions of the core in the direction opposite the rotational direction of the charge roller in use and perpendicular to the axial direction of the charge roller to form the n layers.

In such charge rollers, small-diameter portions are provided at the left and right ends of the charge rollers, and the gap members are fixed to the small-diameter portions. The diameter of the small-diameter portions can be appropriately adjusted so that commercially available films having a thickness corresponding to a desired charge gap can be used. Thus, the charge gap can easily be defined at low cost.

In one of the two methods for producing such charge rollers, the portions of the core where the gap members are to be fixed are covered with the masks, and the conductive coating material is applied to the exposed portion of the circumferential surface of the core with the charge roller being rotated. The masks are then removed from the core before the conductive coating material is applied to the portions of the core where the gap members are to be fixed with the charge roller being rotated. In the other method for producing such charge rollers, the core used includes the small-diameter portions at both ends thereof and the large-diameter portion between the ends thereof, and the conductive coating material is applied to the small-diameter and large-diameter portions with the charge roller being rotated. These methods allow formation of a resistive layer including a large-diameter portion serving as a charging portion and small-diameter portions serving as portions where the gap members are to be fixed.

An image-forming apparatus includes an image-bearing member on which an electrostatic latent image or a developer image is formed, the charge roller according to the aspect of the invention, which charges the image-bearing member without contact, a writing unit that writes an electrostatic latent image on the image-bearing member, a developing unit that develops the electrostatic latent image with a developer to form a developer image on the image-bearing member, and a transfer unit that transfers the developer image from the image-bearing member.

This image-forming apparatus can maintain a uniform, stable charge gap to perform excellent charging of the image-bearing member for high-quality image formation over an extended period of time.

The image-bearing member and the charge roller may be rotated at different circumferential speeds.

If the image-bearing member and the charge roller are rotated at different circumferential speeds, the thickness of the portions of the image-bearing member which come into contact the gap members is decreased by friction with the gap members as the thickness of the charged portion of the image-bearing member is decreased with increasing number of prints. This allows for a reduction in the difference in thickness between the contact portions and charged portion of the image-bearing member. The charge roller can therefore maintain the charge gap at a predetermined width or less to perform excellent charging over an extended period of time. The image-bearing member and the charge roller can thus be rotated at different circumferential speeds to prolong the life of the image-bearing member.

BRIEF DESCRIPTION OF THE DRAWINGS

The invention will be described with reference to the accompanying drawings, wherein like numbers reference like elements.

FIG. 3A is a partial front view of the charge roller. FIG. 3B is a right side view of the charge roller. FIG. 3C is a sectional view taken along line IIIC-IIIC of FIG. 3B.

FIG. 5A is a partial front view of the charge roller. FIG. 5B is a right side view of the charge roller. FIG. 5C is a sectional view taken along line VC-VC of FIG. 5B.

FIG. 6A is a partial front view of the charge roller. FIG. 6B is a right side view of the charge roller. FIG. 6C is a sectional view taken along line VIC-VIC of FIG. 6B.

FIG. 7A is a partial front view of the charge roller. FIG. 7B is a sectional view taken along line VIIB-VIIB of FIG. 7A. FIG. 7C is a sectional view taken along line VIIC-VIIC of FIG. 7B.

FIG. 8A is a partial front view of the charge roller. FIG. 8B is a right side view of the charge roller. FIG. 8C is a sectional view taken along line VIIIC-VIIIC of FIG. 8B.

FIG. 10A is a partial front view of the charge roller. FIG. 10B is a right side view of the charge roller. FIG. 10C is a sectional view taken along line XC-XC of FIG. 10B.

DESCRIPTION OF EXEMPLARY EMBODIMENTS

Exemplary embodiments of the invention will now be described with reference to the drawings.

Figure 1:
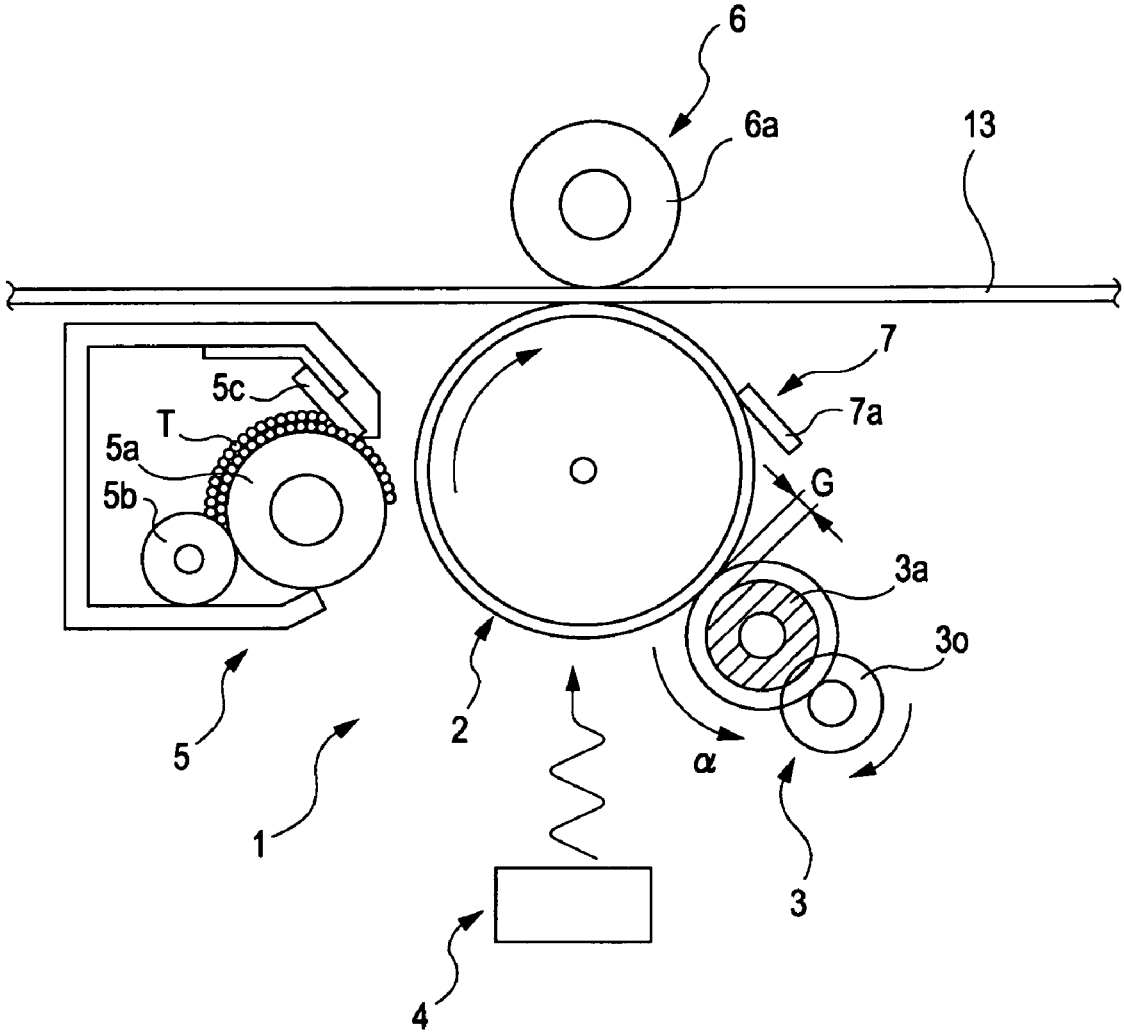
FIG. 1 is a partial schematic diagram of an image-forming apparatus according to an embodiment of the invention.
Figure 2:
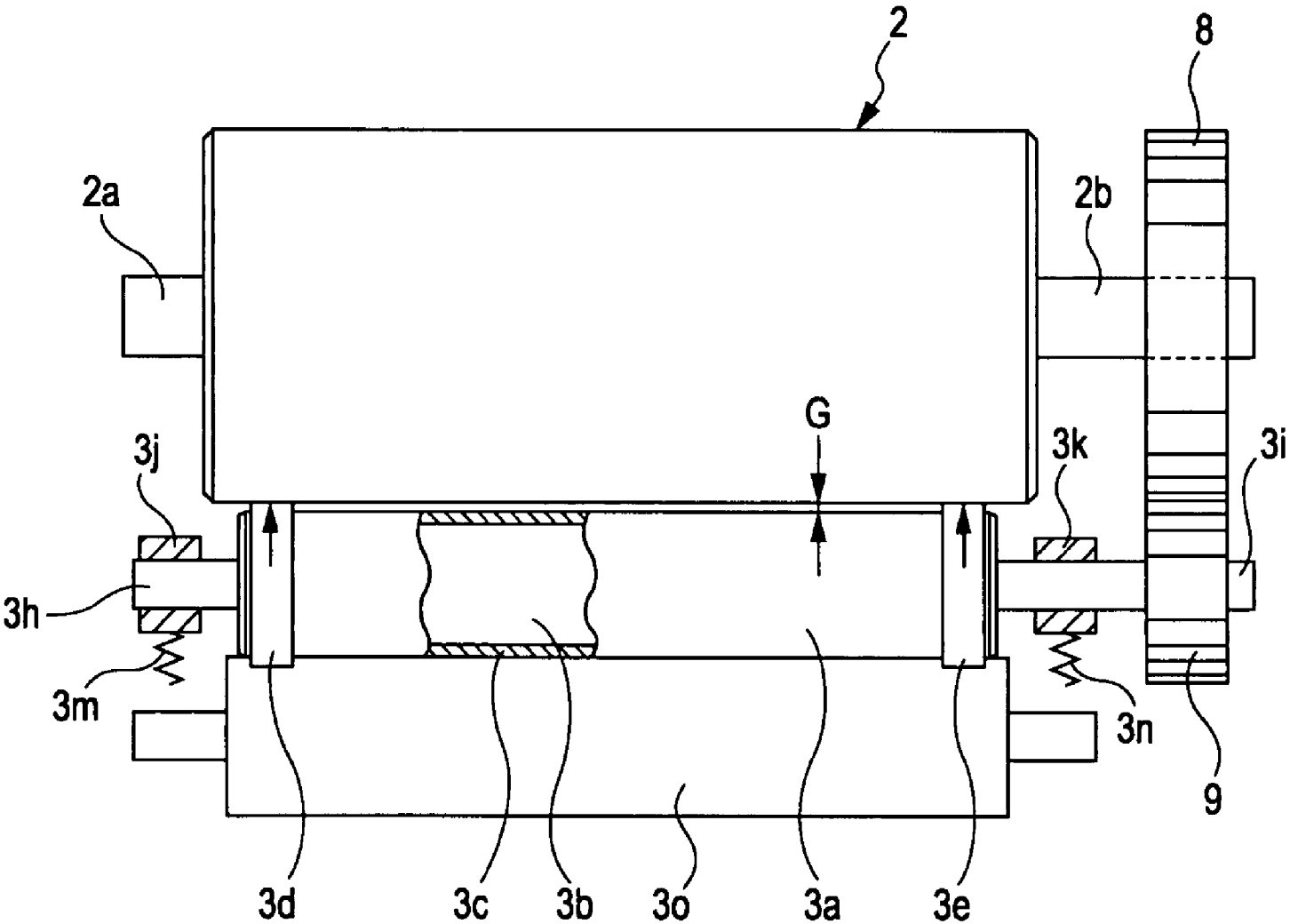
FIG. 2 is a schematic diagram of a photosensitive member, a charge roller, and a cleaning member used in the image-forming apparatus shown in FIG. 1.

FIG. 1 is a partial schematic diagram of an image-forming apparatus according to an embodiment of the invention. FIG. 2 is a schematic diagram of a photosensitive member and a charge unit of the apparatus shown in FIG. 1. In the description of each embodiment below, the same reference numerals as used in the previous embodiments indicate the same components, and detailed description thereof is omitted.

In FIGS. 1 and 2, an image-forming apparatus 1 includes a photosensitive member 2 serving as an image-bearing member on which an electrostatic latent image or a toner image (developer image) is formed. This photosensitive member 2 is surrounded by, in order from the upstream side in the rotational direction of the photosensitive member 2 (clockwise in FIG. 1), a charge unit 3 including a charge roller 3*a* that charges the photosensitive member 2 without contact, an optical writing unit 4 that writes an electrostatic latent image on the photosensitive member 2, a developing unit 5 that develops the electrostatic latent image with toner to form a toner image on the photosensitive member 2, a transfer unit 6 that transfers the toner image from the photosensitive member 2, and a cleaning unit 7 that cleans the photosensitive member 2. The photosensitive member 2 and the charge roller 3*a*, or the photosensitive member 2, the charge roller 3*a*, and the developing unit 5, may be integrated into a cartridge.

In this embodiment, the photosensitive member 2 is a photosensitive drum, similar to known photosensitive drums, formed of a metal pipe coated with a photosensitive layer having a predetermined thickness. The metal pipe used is a conductive pipe such as an aluminum pipe. The photosensitive layer is formed of a known organic photosensitive material. This photosensitive member 2 has rotating shafts 2*a* and 2*b* protruding coaxially from end surfaces thereof in the axial direction. These rotating shafts 2*a* and 2*b* are rotatably supported by the main body of the apparatus (not shown in FIG. 1) using bearings.

In FIG. 2, the charge roller 3*a* of the charge unit 3 includes a core 3*b* formed of a conductive shaft, such as a metal shaft, and a resistive layer 3*c* disposed on a circumferential surface 3*g* of the core 3*b*. The conductive shaft used for the core 3*b* may be, for example, a nickel-plated shaft formed of SUM22 (according to Japanese Industrial Standards (JIS). The resistive layer 3*c* is a conductive layer formed by, for example, coating the core 3*b* with a substantially inelastic conductive coating material using an appropriate method such as spraying.

Figure 3B:
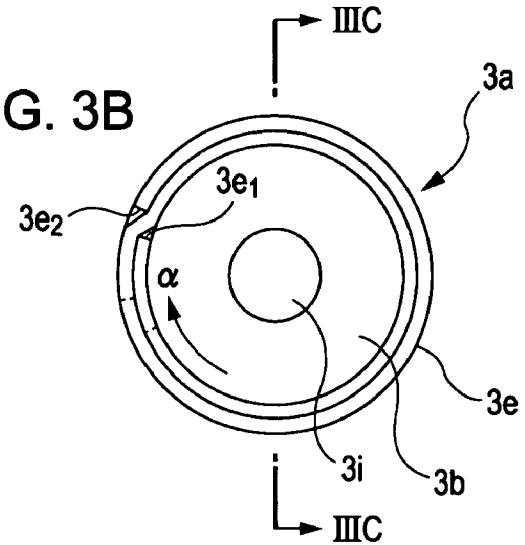
FIGS. 3A to 3C are schematic diagrams of the right end of the charge roller according to this embodiment.
Figure 3A:
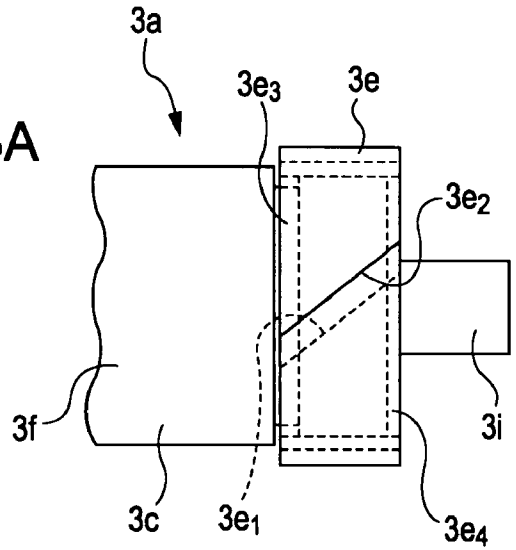
Figure 3C:
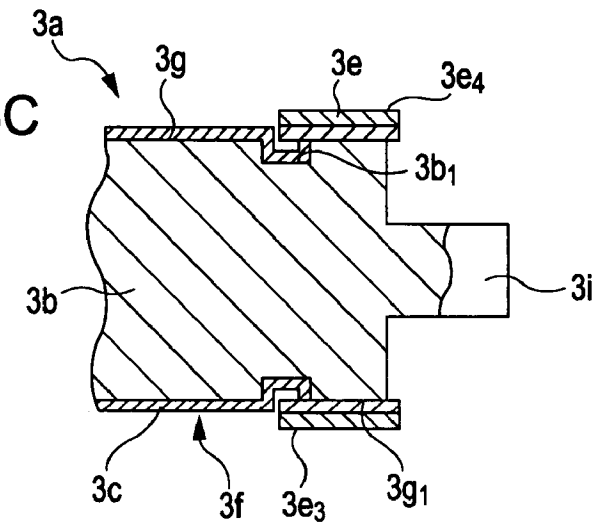

FIGS. 3A to 3C are schematic diagrams of the right end of the charge roller 3*a* according to this embodiment. FIG. 3A is a partial front view of the charge roller 3*a*. FIG. 3B is a right side view of the charge roller 3*a*. FIG. 3C is a sectional view taken along line IIIC-IIIC of FIG. 3B.

In FIGS. 3A to 3C, the charge roller 3*a* according to this embodiment has an annular groove $\mathbf{3}b_1$ on the circumferential surface 3*g* of the core 3*b*. This annular groove $\mathbf{3}b_1$ is rectangular in axial cross section and is separated from the right end of the charge roller 3*a* toward the center thereof by a predetermined distance. Although not illustrated, another annular groove similar to the right annular groove $\mathbf{3}b_1$ is formed at the left end of the circumferential surface 3*g* of the core 3*b* such that the two annular grooves are symmetrical with respect to the center of the core 3*b*. The shape of the annular grooves in axial cross section is not limited to a rectangular shape and may be any other shape such as an arc shape, a U-shape, or a V-shape.

Figure 14A:
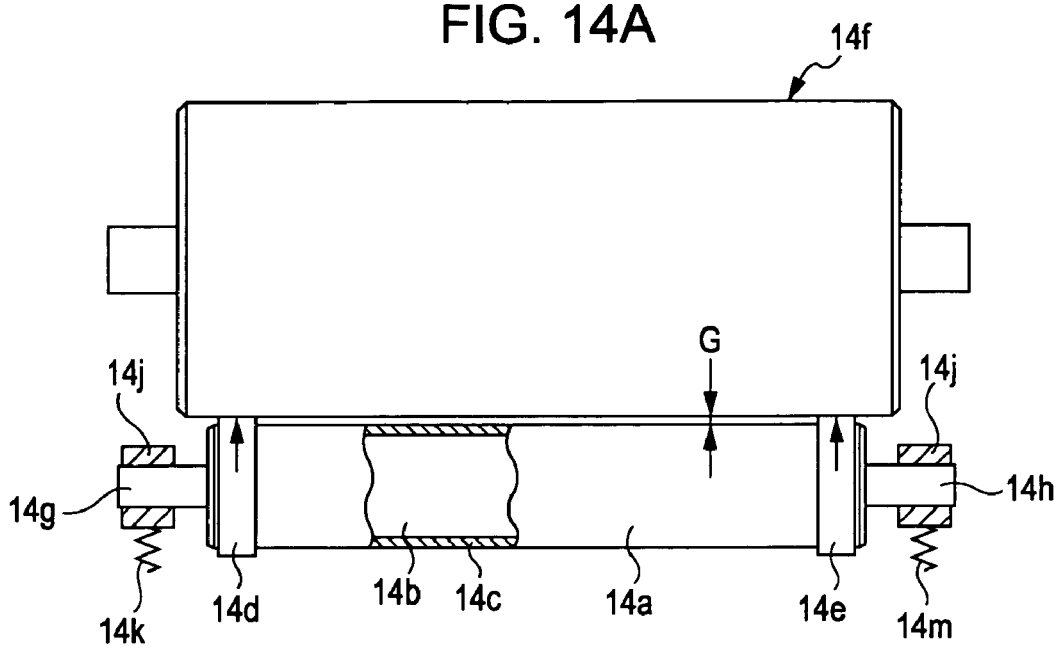
FIG. 14A is a schematic diagram of a photosensitive member and a charge roller used in a known image-forming apparatus.
Figure 14C:
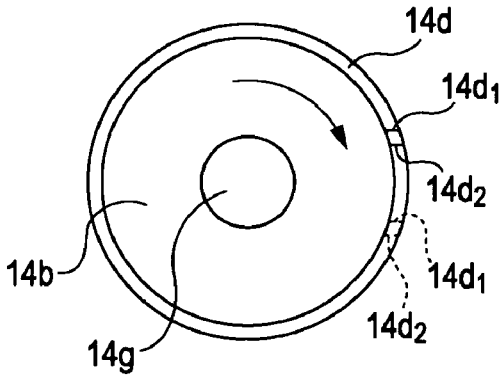
FIG. 14C is a left side view of the gap member shown in FIG. 14B.
Figure 14B:
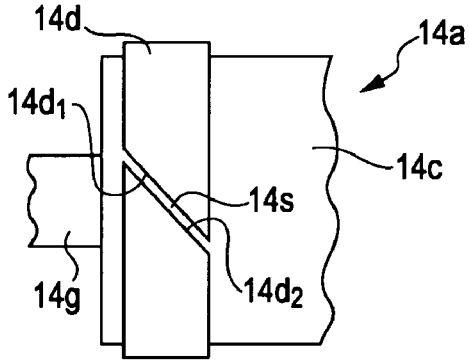
FIG. 14B is a partial enlarged view of a known example of a gap member shown in FIG. 14A.
Figure 14E:
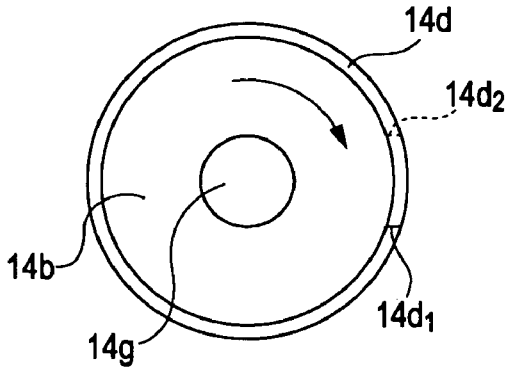
FIG. 14E is a left side view of the gap member shown in FIG. 14D.
Figure 14D:
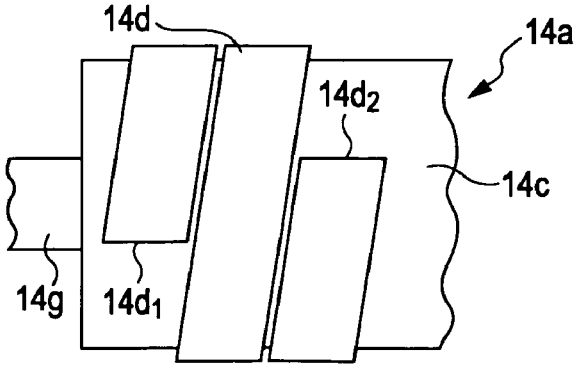
FIG. 14D is a partial enlarged view of another known example of the gap member shown in FIG. 14A.

The resistive layer 3*c* not only covers the circumferential surface 3*g* of the core 3*b* between the two annular grooves, but also covers the inner surfaces of the grooves, and thus has annular grooves formed over the grooves. In FIG. 3C, the resistive layer 3*c* does not cover a circumferential surface $\mathbf{3}g_1$ of the core 3*b* on the right side of the right annular groove $\mathbf{3}b_1$ and a right end surface $\mathbf{3}b_2$. The right gap member 3*e* is directly fixed to the circumferential surface $\mathbf{3}g_1$ of the core 3*b* without the resistive layer 3*c* disposed therebetween. The gap member 3*e* is formed of a tape-shaped film having ends $\mathbf{3}e_1$ and $\mathbf{3}e_2$ cut obliquely in parallel, as in the example of the known art shown in FIG. 14B. These ends $\mathbf{3}e_1$ and $\mathbf{3}e_2$ are cut in parallel obliquely down to the left in the example shown in FIG. 3A, although they may also be cut in parallel obliquely up to the left.

The end $\mathbf{3}e_1$ of the film of the gap member 3*e* at which the film starts entering a contact position (nip) between the charge roller 3*a* and the photosensitive member 2 is fixed to the charge roller 3*a* by adhesion or bonding. The rest of the film is wound around the circumferential surface $\mathbf{3}g_1$ of the charge roller 3*a* by one turn in a direction opposite a rotational direction $\alpha$ of the charge roller 3*a* in use, indicated by the arrow in FIGS. 1 and 3B, and perpendicular to the axial direction of the charge roller 3*a* without being shifted in the axial direction. The film is further wound around the first layer of the film by slightly less than one turn without being shifted in the axial direction and is fixed by adhesion or bonding. That is, the film is fixed to the charge roller 3*a* by winding the film in layers around the charge roller 3*a* by slightly less than two turns without shifting the film in the axial direction. In this embodiment, the film is wider than the circumferential surface $\mathbf{3}g_1$ of the core 3*b* in the axial direction. The left side $\mathbf{3}e_3$ of the film protrudes to the adjacent annular groove of the resistive layer 3*c* in the axial direction while the right side $\mathbf{3}e_4$ of the film protrudes to the right beyond the right end surface $\mathbf{3}b_2$ of the core 3*b* in the axial direction.

In the wound state, the end $\mathbf{3}e_1$ of the gap member 3*e* faces the rotational direction a of the charge roller 3*a* while the other end $\mathbf{3}e_2$, at which the film exits the contact position between the charge roller 3*a* and the photosensitive member 2, faces the opposite direction. The end $\mathbf{3}e_2$ of the gap member 3*e*, indicated by the solid line, is located ahead of the end $\mathbf{3}e_1$, indicated by the dotted line, in the circumferential direction of the charge roller 3*a*. That is, the ends $\mathbf{3}e_1$ and $\mathbf{3}e_2$ of the gap member 3*e* are separated from each other in the circumferential direction by a predetermined distance, as in the example of the known art shown in FIG. 14B. The obliquely cut portions of the ends $\mathbf{3}e_1$ and $\mathbf{3}e_2$ overlap each other in the axial direction. Thus, the film is wound by slightly less than two turns to form two layers extending in the axial direction at every position in the circumferential direction of the charge roller 3*a*.

In addition, the end $3e_1$ of the gap member 3*e* is covered by the second layer of the film so as not to come into contact with the photosensitive member 2 when entering the contact position between the charge roller 3*a* and the photosensitive member 2. This prevents the photosensitive member 2 from exerting a force having such a direction as to peel the gap member 3*e* on the end $3e_1$ of the gap member 3*e*.

Although not illustrated, the left gap member 3*d* is similarly wound around the charge roller 3*a*. That is, the film of the gap member 3*d* is wound by slightly less than two turns to form two layers extending in the axial direction at every position in the circumferential direction of the charge roller 3*a*. The ends of the gap member 3*d* may be cut in parallel in any oblique direction, for example, in the same direction as the end $3e_1$ and $3e_2$ or symmetrically therewith. One end of the gap member 3*d* is located at the same position (phase) as the end $3e_1$ of the gap member 3*e* in the circumferential direction of the charge roller 3*a*. That is, these ends overlap each other in the axial direction of the charge roller 3*a*. Also, these ends may be located at different positions (phases) in the circumferential direction of the charge roller 3*a*.

The resistive layer 3*c*, which is formed on the circumferential surface 3*g* between the annular groove $3b_1$ of the core 3*b*, constitutes a charging portion 3*f* that charges the photosensitive member 2 without contact across the predetermined charge gap G. This charging portion 3*f* has a circumferential surface that is circular in cross section with a predetermined diameter along the axial direction of the charge roller 3*a*.

The charge roller 3*a* has rotating shafts 3*h* and 3*i* protruding coaxially from end surfaces of the core 3*b* in the axial direction. These rotating shafts 3*h* and 3*i* are rotatably supported by bearings 3*j* and 3*k*, respectively. As in the example of the known art, compression springs 3*m* and 3*n* urge the bearings 3*j* and 3*k*, respectively, to push the charge roller 3*a* toward the photosensitive member 2, thereby bringing the gap members 3*d* and 3*e* into contact with the circumferential surface of the photosensitive member 2. The predetermined charge gap G is thus defined between the resistive layer 3*c* and the photosensitive member 2. The width of the charge gap G depends on the predetermined thickness of the films.

The width of the charge gap G is twice the thickness of the films of the gap members 3*d* and 3*e*. To define the desired charge gap G, therefore, the thickness of the films may be adjusted to half the width of the charge gap G. If no self-adhesive film having such a thickness is commercially available, films having a thickness that is most approximate to half the width of the charge gap G may be used. In this case, the charge gap G can easily be defined at low cost. The films used may be, for example, resin films such as polyester films and Kapton® films.

A method for producing the charge roller 3*a* according to this embodiment will be described.

FIGS. 4A to 4E are diagrams illustrating the method for producing the charge roller 3*a*. FIGS. 4A to 4E illustrate only the right side of the charge roller 3*a*, and the left side thereof is not illustrated. The description below focuses on the right side of the charge roller 3*a*, although the left side is similarly formed.

Figure 4A:
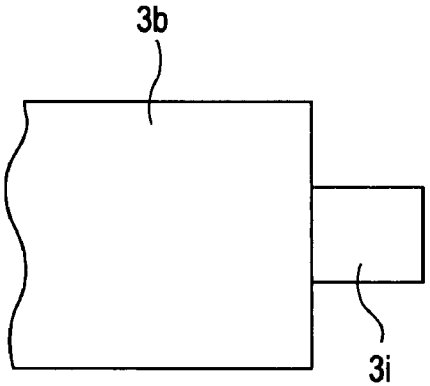
FIGS. 4A to 4E are diagrams illustrating a method for producing the charge roller shown in FIGS. 3A to 3C.
Figure 4B:
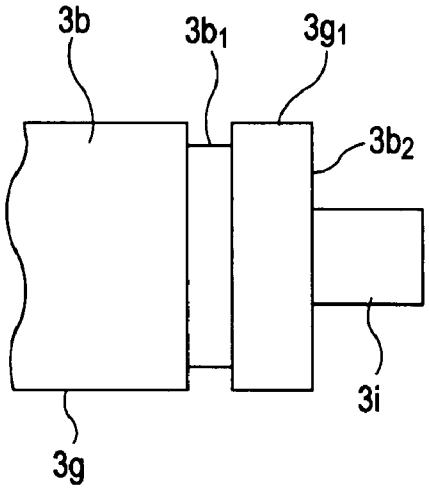
Figure 4C:
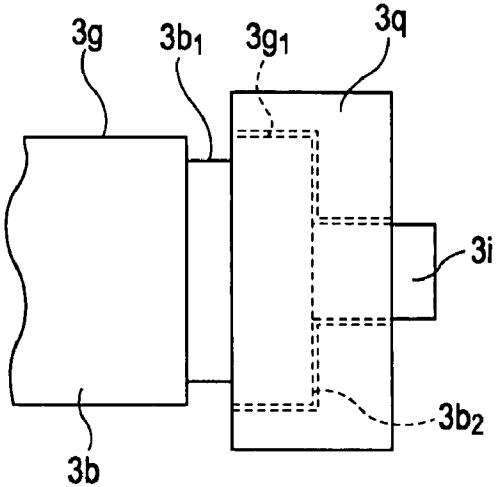
Figure 4D:
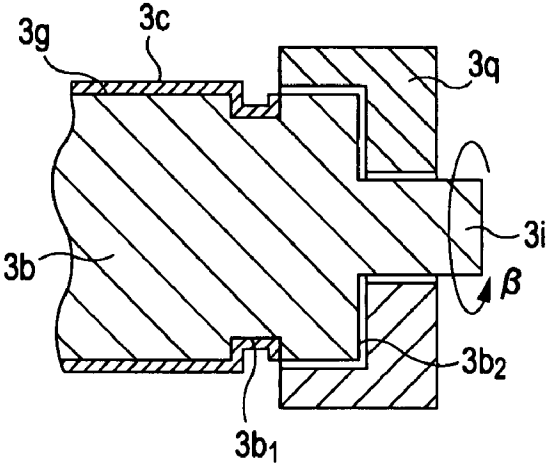

Referring to FIG. 4A, first, the core 3*b* is prepared. This core 3*b* has the rotating shaft 3*i* and is formed of a metal shaft having a predetermined length and a predetermined diameter. Referring to FIG. 4B, the annular groove $3b_1$ is formed at the right end of the circumferential surface 3*g* of the core 3*b*. Referring to FIG. 4C, a masking/bearing member 3*q* is provided so as to cover the circumferential surface $3g_1$ of the core 3*b*, the right end surface $3b_2$, and part of the rotating shaft 3*i* adjacent to the core 3*b* and rotatably support the rotating shaft 3*i*. Referring to FIG. 4D, the resistive layer 3*c* is formed by applying a conductive coating material to the circumferential surface 3*g* of the core 3*b*, which is not covered by the masking/bearing member 3*q*, to a predetermined thickness while rotating the charge roller 3*a* in, for example, the β direction. The conductive coating material is also applied to the inner surface of the annular groove $3b_1$. The conductive coating material can be uniformly applied to the circumferential surface 3*g* of the core 3*b* by rotating the charge roller 3*a*. Without the annular groove $3b_1$, the boundary (edge) of the resistive layer 3*c* is difficult to reliably define by applying the conductive coating material. The annular groove $3b_1$ allows reliable definition of the boundary of the resistive layer 3*c* and more uniform application of the conductive coating material to the circumferential surface 3*g* of the core 3*b*. The coating may be performed either by a dry process or by a wet process. After the coating is completed, the core 3*b* is removed from the masking/bearing member 3*q*.

Figure 4E:
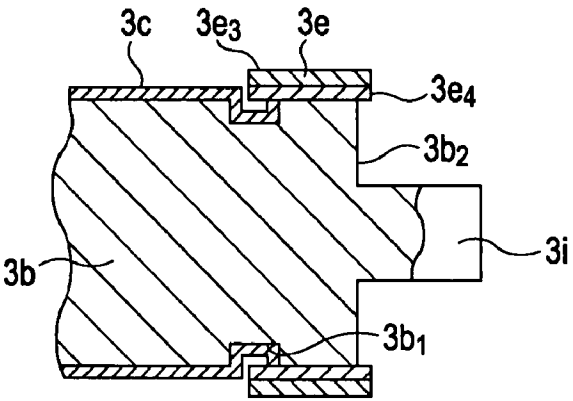

Referring to FIG. 4E, finally, a tape-shaped film that has ends cut obliquely and is wider than the circumferential surface $3g_1$ of the core 3*b* in the axial direction is prepared. As described above, one of the ends of the film is fixed to the circumferential surface $3g_1$ without the resistive layer 3*c* disposed therebetween by direct adhesion or bonding. The film is then wound around the circumferential surface $3g_1$ by one turn in the direction opposite the rotational direction α of the charge roller 3*a* in use and perpendicular to the axial direction of the charge roller 3*a*. The film is further wound around the first turn of the film and is fixed by adhesion or bonding. The film is wound so that the left side $3e_3$ of the film protrudes to the adjacent annular groove of the resistive layer 3*c* in the axial direction and that the right side $3e_4$ of the film protrudes to the right beyond the right end surface $3b_2$ of the core 3*b* in the axial direction. Thus, the charge roller 3*a* is completed.

The resistive layer 3*c* may also be formed of an elastic conductive rubber film having a predetermined width, rather than the inelastic conductive coating described above.

The charge unit 3 further includes a cleaning member 3*o*, such as a sponge tube roller, which cleans the charge roller 3*a*. This cleaning member 3*o* is brought into contact with the circumferential surface 3*g* of the charge roller 3*a* and the pair of gap members 3*d* and 3*e* at a predetermined pressure. The cleaning member 3*o* is rotatable in the direction opposite the rotational direction of the charge roller 3*a*. While the charge roller 3*a* uniformly charges the photosensitive member 2 without contact, the cleaning member 3*o* cleans the charge roller 3*a* to remove foreign matter, such as toner and dust, deposited on the charge roller 3*a*.

In FIG. 2, a drive gear 8 for rotating the photosensitive member 2 is attached to the right rotating shaft 2*b* of the photosensitive member 2, and a drive gear 9 for rotating the charge roller 3*a* is attached to the right rotating shaft 3*i* of the charge roller 3*a*. The drive gear 8 transmits a driving force produced by a motor (not shown) to the photosensitive member 2 to rotate the photosensitive member 2 and also transmits the driving force to the drive gear 9 to rotate the charge roller 3*a*.

The optical writing unit 4 writes an electrostatic latent image on the photosensitive member 2 by, for example, laser light. The developing unit 5 includes a developing roller 5*a*, a toner supply roller 5*b*, and a toner-limiting member 5*c*. The toner supply roller 5*b* supplies a toner T serving as a developer onto the developing roller 5*a*. The toner-limiting member 5*c* limits the thickness of the toner T on the developing roller 5*a* before the developing roller 5*a* conveys the toner T to the photosensitive member 2. The developing unit 5 thus develops the electrostatic latent image with the toner T to form a toner image on the photosensitive member 2.

The transfer unit 6 includes a transfer roller 6*a* that transfers the toner image from the photosensitive member 2 to a transfer medium 13 such as transfer paper or an intermediate transfer medium. If the toner image is transferred to transfer paper, a fusing unit (not shown) fuses the transferred image on the paper. If the toner image is transferred to an intermediate transfer medium, the image is further transferred to transfer paper, and the fusing unit fuses the transferred image on the paper.

The cleaning unit 7 includes a cleaning member 7*a* such as a cleaning blade. This cleaning member 7*a* cleans the photosensitive member 2 to remove and recover residual toner from the photosensitive member 2 after the transfer.

In the image-forming apparatus 1 having the structure described above, the circumferential surfaces of the second layers of the gap members 3*d* and 3*e* come into contact with the photosensitive member 2 to define a uniform, predetermined charge gap G between the photosensitive member 2 and the charging portion 3*f* of the charge roller 3*a* at any position in the circumferential direction of the charge roller 3*a*. The width of the charge gap G is twice the thickness of the films of the gap members 3*d* and 3*e*.

In FIG. 1, the charge roller 3*a* rotates counterclockwise while the photosensitive member 2 rotates clockwise. Accordingly, the end $3e_1$ of the gap member 3*e* is the end at which the gap member 3*e* starts entering the contact position between the photosensitive member 2 and the gap member 3*e*. The end $3e_1$ of the gap member 3*e* does not come into contact with the photosensitive member 2 when entering the nip between the photosensitive member 2 and the gap member 3*e* because the end $3e_1$ is covered by the second layer of the film. This prevents the photosensitive member 2 from exerting a force having such a direction as to peel the gap member 3*e* on the end $3e_1$ of the gap member 3*e*. Although the photosensitive member 2 exerts a force on the second layer of the film when it enters the nip and comes into contact with the photosensitive member 2, no force having such a direction as to peel the gap member 3*e* acts on the end $3e_1$ when it passes through the nip. The end $3e_1$ of the gap member 3*e* does not peel off the charge roller 3*a* after extended image-forming operation (printing operation) of the image-forming apparatus 1 because the end $3e_1$ is protected by the second layer of the film.

As the charge roller 3*a* rotates, the photosensitive member 2 also exerts a force on the other end $3e_2$ of the gap member 3*e*. This force, however, does not peel the end $3e_2$ off the first layer of the film because the force has such a direction as to press the end $3e_2$ onto the first layer of the film, rather than to peel the film. The same holds true for the other gap member 3*d*. In addition, the gap members 3*d* and 3*e* have the same thickness (twice the thickness of the films) at any position in the circumferential direction of the charge roller 3*a*. The gap members 3*d* and 3*e* can therefore maintain a uniform, stable charge gap G to perform excellent charging of the photosensitive member 2 for high-quality image formation over an extended period of time.

Furthermore, each of the films is wound so that the left side $3e_3$ of the film protrudes to the adjacent annular groove of the resistive layer 3*c* and that the right side $3e_4$ of the film protrudes to the right beyond the right end surface $3b_2$ of the core 3*b*. These protrusions prevent abnormal discharge (leakage of charge) between the exposed portion of the core 3*b* and the photosensitive member 2.

In the image-forming apparatus 1 according to this embodiment, the gap members 3*d* and 3*e* extend in the axial direction at every position in the circumferential direction of the charge roller 3*a* so as to have a uniform thickness. In addition, the end of each gap member at which it starts entering the contact position between the charge roller 3*a* and the photosensitive member 2 is covered by the second layer of the film of the gap member so as not to come into contact with the photosensitive member 2 when entering the nip. This prevents the peeling of the gap members 3*d* and 3*e* off the charge roller 3*a* after extended image-forming operation (printing operation). In particular, the peeling of the gap members 3*d* and 3*e* can be prevented more effectively by forming the resistive layer 3*c* with a material having a relatively low elastic coefficient, such as a conductive rubber, so that the resistive layer 3*c* can readily be elastically deformed by a pressure applied at the contact position (nip) between the charge roller 3*a* and the photosensitive member 2.

In addition, little foreign matter such as toner particles adheres to the ends of the gap members 3*d* and 3*e* because they are seamless. In particular, the end of the film of each gap member at which it starts entering the contact position can be covered and protected by the second layer of the film to prevent the peeling of the end of film more effectively. The gap members 3*d* and 3*e* can therefore maintain a uniform, stable charge gap G to perform excellent charging of the photosensitive member 2 for high-quality image formation over an extended period of time.

Furthermore, a uniform, stable charge gap G can readily be defined over an extended period of time without peeling of the films simply by winding them to form two layers.

In addition, the annular grooves formed on the resistive layer 3*c* can inhibit intrusion of toner into the bottom sides of the ends of the films to prevent the peeling of the ends of the films over an extended period of time, and can also cancel out coating unevenness at both ends of the conductive coating.

Furthermore, each of the films is wound so that the left side $3e_3$ of the film protrudes to the adjacent annular groove of the resistive layer 3*c* and that the right side $3e_4$ of the film protrudes to the right (outward) beyond the right end surface $3b_2$ of the core 3*b*. These protrusions can prevent abnormal discharge (leakage of charge) between the exposed portion of the core 3*b* and the photosensitive member 2.

Figure 5B:
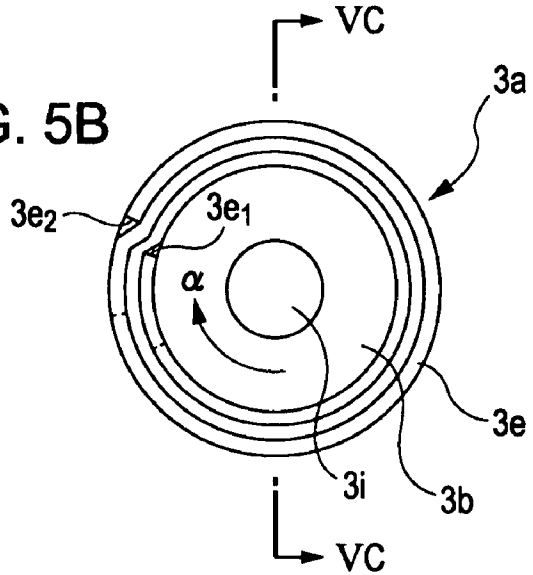
FIGS. 5A to 5C are schematic diagrams of the right end of a charge roller according to another embodiment of the invention.
Figure 5A:
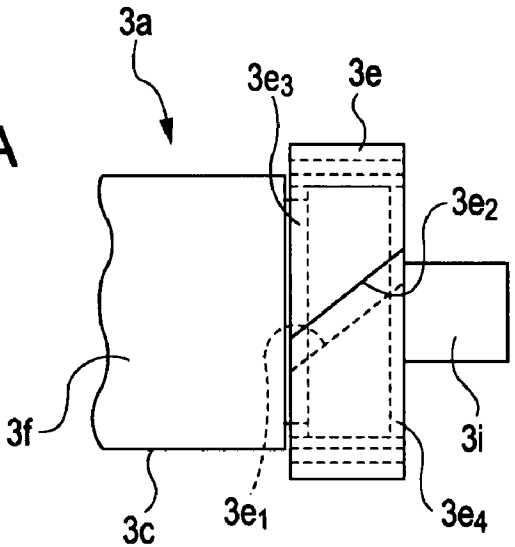
Figure 5C:
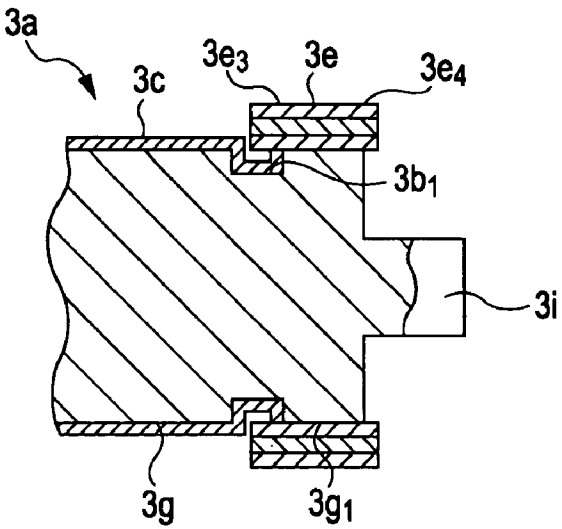

Each of the films is wound around the charge roller 3*a* by slightly less than two turns to form two layers in this embodiment, although the invention is not limited to the example above. Referring to FIGS. 5A to 5C, for example, the film of the right gap member 3*e* may be wound in layers around the charge roller 3*a* by slightly less than three turns without being shifted in the axial direction. Also, the film may be wound in layers around the charge roller 3*a* by slightly less than four turns or more without being shifted in the axial direction. The film of the left gap member 3*d* may be wound in layers by the same number of turns as the film of the right gap member 3*e*.

That is, each of the films of the gap members 3*d* and 3*e* is wound by slightly less than n turns (wherein $n \geqq 2$) to form n layers extending in the axial direction at every position in the circumferential direction of the charge roller 3*a*. The outermost circumferential surfaces of the films of the gap members 3*d* and 3*e* come into contact with the photosensitive member 2 to define the predetermined charge gap G between the photosensitive member 2 and the charging portion 3*f* of the charge roller 3*a* at any position in the circumferential direction of the charge roller 3*a*.

If a film having a thickness of t is wound to form n layers extending in the axial direction at every position in the circumferential direction of the charge roller 3*a*, the charge gap G corresponds to the difference between the thickness of the gap members 3*d* and 3*e*, namely n·t, and the thickness of the resistive layer 3*c* at the charging portion 3*f* of the charge roller 3*a*. To define the desired charge gap G, in other words, the thickness of the resistive layer 3*c* may be determined by subtracting the charge gap G from the thickness of the gap members 3*d* and 3*e*, namely n·t.

Figure 6B:
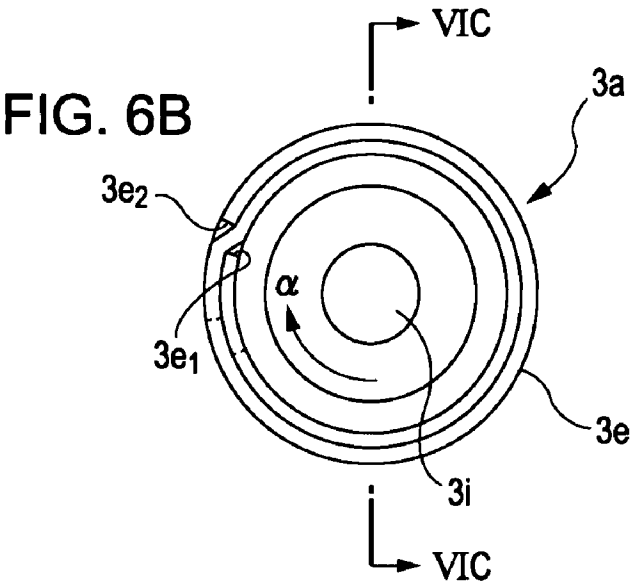
FIGS. 6A to 6C are schematic diagrams of the right end of a charge roller according to another embodiment of the invention.
Figure 6A:
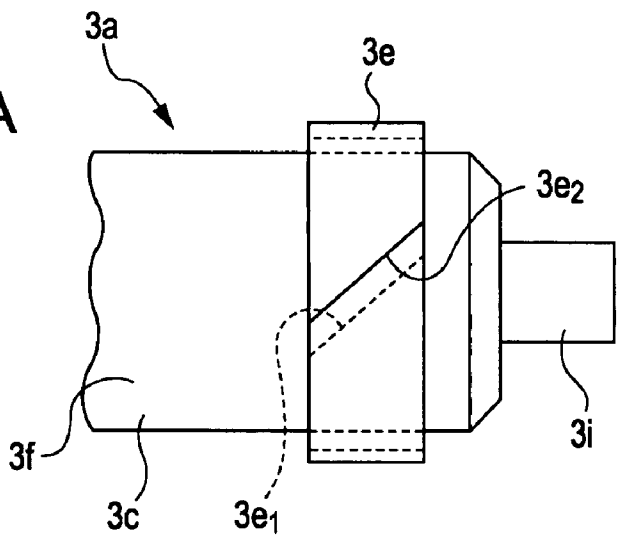
Figure 6C:
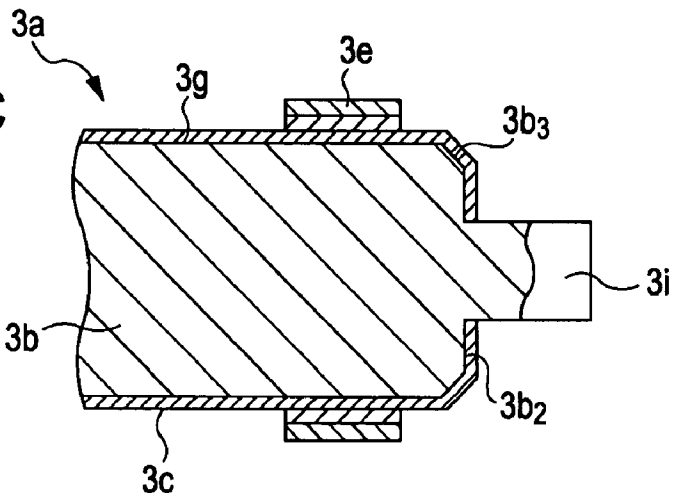

FIGS. 6A to 6C are schematic diagrams, similar to FIGS. 3A to 3C, of a charge roller according to another embodiment of the invention. FIG. 6A is a partial front view of the charge roller. FIG. 6B is a right side view of the charge roller. FIG. 6C is a sectional view taken along line VIC-VIC of FIG. 6B.

In the previous embodiment, the annular grooves are formed at both ends of the charge roller 3*a*, and the gap members 3*d* and 3*e* are directly fixed to the circumferential surfaces $3g_1$ of the core 3*b*, which are not covered by the resistive layer 3*c*. In this embodiment, as shown in FIGS. 6A to 6C, the charge roller 3*a* has no annular groove, and a beveled portion $3b_3$ is formed at the right side edge (right edge) of the core 3*b*. In addition, the resistive layer 3*c* covers the circumferential surface 3*g*, beveled portion $3b_3$, and right end surface $3b_2$ of the core 3*b*. The circumferential surface 3*g* of the core 3*b* has a uniform diameter along the axial direction of the charge roller 3*a* between the left and right beveled portions of the core 3*b*. Accordingly, the circumferential surface of the resistive layer 3*c*, which is formed on the circumferential surface 3*g* of the core 3*b*, is circular in cross section with a uniform diameter along the axial direction of the charge roller 3*a*. The right gap member 3*e* is fixed to the right end of the circumferential surface 3*g* of the core 3*b*. The left side of the core 3*b* and the left gap member 3*d* are similar to but symmetrical with the right side of the core 3*b* and the right gap member 3*e*.

In this embodiment, the resistive layer 3*c* covers the beveled portion $3b_3$ and right end surface $3b_2$ of the core 3*b* to prevent abnormal discharge (leakage of charge) between the core 3*b* and the photosensitive member 2. The left side of the core 3*b* is similar to the right side. In addition, the gap members 3*d* and 3*e* are fixed to the resistive layer 3*c* to define the charge gap G with respect to the coating surface. This allows for improved dimensional accuracy if, for example, coating unevenness occurs.

The rest of the structure and the other operations and advantages of the image-forming apparatus 1 and the charge roller 3*a* according to this embodiment are the same as those of the embodiment shown in FIGS. 1 to 4A-4E except for the operations and advantages of the annular grooves.

Also, in this embodiment, each of the films of the gap members 3*d* and 3*e* is wound by slightly less than n turns (wherein n≧2) to form n layers extending in the axial direction at every position in the circumferential direction of the charge roller 3*a*. In addition, the resistive layer 3*c* may be formed of an elastic conductive rubber film having a predetermined width, rather than the inelastic conductive coating described above.

Figure 7B:
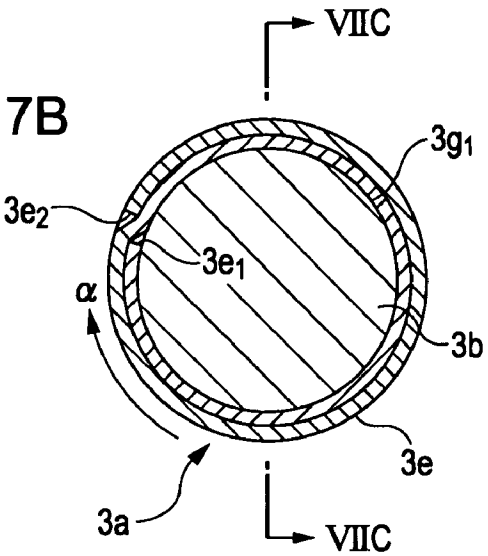
FIGS. 7A to 7C are schematic diagrams of the right end of a charge roller according to another embodiment of the invention.
Figure 7A:
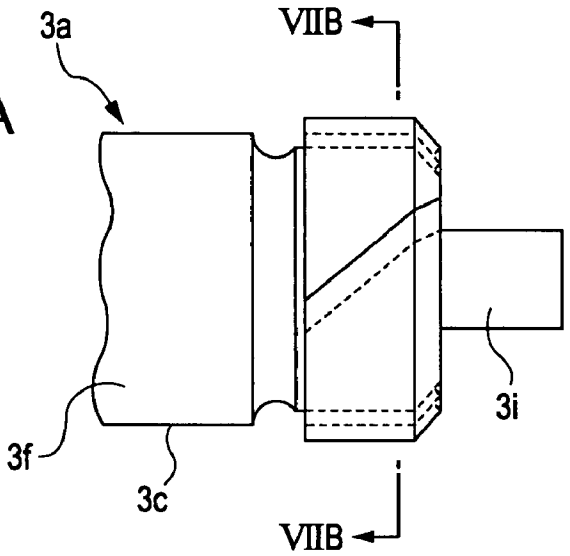
Figure 7C:
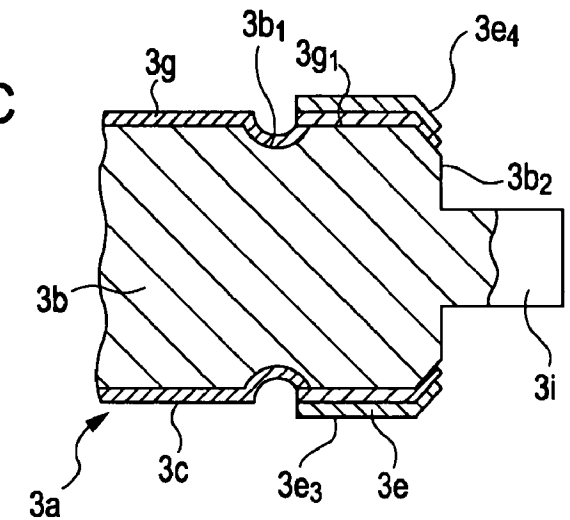

FIGS. 7A to 7C are schematic diagrams, similar to FIGS. 3A to 3C, of a charge roller of an image-forming apparatus according to another embodiment of the invention. FIG. 7A is a partial front view of the charge roller. FIG. 7B is a sectional view taken along line VIIB-VIIB of FIG. 7A. FIG. 7C is a sectional view taken along line VIIC-VIIC of FIG. 7B.

In the embodiment shown in FIGS. 3A to 3C, the annular groove $3b_1$ of the core 3*b* is rectangular in axial cross section, and the beveled portion $3b_3$ is not formed at the right edge of the core 3*b*. In this embodiment, as shown in FIGS. 7A to 7C, the annular groove $3b_1$ of the core 3*b* is arc-shaped in axial cross section, and the beveled portion $3b_3$ is formed at the right edge of the core 3*b*. The annular groove $3b_1$ may also be, for example, U-shaped or V-shaped in axial cross section.

In the embodiment shown in FIGS. 3A to 3C, additionally, the left side $3e_3$ of the film of the gap member 3*e* protrudes to the adjacent annular groove of the resistive layer 3*c*, and the right side $3e_4$ of the film protrudes to the right beyond the right end surface $3b_2$ of the core 3*b*. In this embodiment, on the other hand, the left side $3e_3$ of the film of the gap member 3*e* does not protrude to the adjacent annular groove of the resistive layer 3*c*, but covers the boundary between the annular groove $3b_1$ and circumferential surface $3g_1$ of the core 3*b* so that the boundary is not directly exposed. In this embodiment, additionally, the right side $3e_4$ of the first layer of the film is bent and fixed to part of the beveled portion $3b_3$ of the core 3*b* by adhesion or bonding, and the right side $3e_4$ of the second layer of the film is fixed to the first layer so that the second layer is bent along the bent portion of the first layer. The first and second layers of the film are thus bent away from the photosensitive member 2 at the right side $3e_4$ thereof. The left side of the core 3*b* and the left gap member 3*d* are similar to but symmetrical with the right side of the core 3*b* and the right gap member 3*e*.

In this embodiment, the outer sides of the left and right films are bent away from the photosensitive member 2 to increase the adhesive strength of the films. In addition, the outer sides do not come into contact with the photosensitive member 2. The peeling of the gap members 3*d* and 3*e* can therefore be prevented effectively over an extended period of time even if parts of the gap members 3*d* and 3*e* come into contact with the photosensitive member 2 and the cleaning member 3*o*.

Furthermore, the left side $3e_3$ of the film covers the boundary between the annular groove $3b_1$ and circumferential surface $3g_1$ of the core 3*b* so that the boundary is not directly exposed, and the right side $3e_4$ of the film covers the beveled portion $3b_3$. The film can therefore prevent abnormal discharge (leakage of charge) between the boundary and beveled portion $3b_3$ of the core 3*b* and the photosensitive member 2. The left side of the core 3*b* is similar to the right side.

The rest of the structure and the other operations and advantages of the image-forming apparatus 1 and the charge roller 3*a* according to this embodiment are the same as those of the embodiment shown in FIGS. 1 to 4A-4E. The resistive layer 3*c* may be formed of an elastic conductive rubber film having a predetermined width, rather than the inelastic conductive coating described above. In addition, each of the films of the gap members 3*d* and 3*e* is wound by slightly less than n turns (wherein n≧2) to form n layers extending in the axial direction at every position in the circumferential direction of the charge roller 3*a*.

Figure 8B:
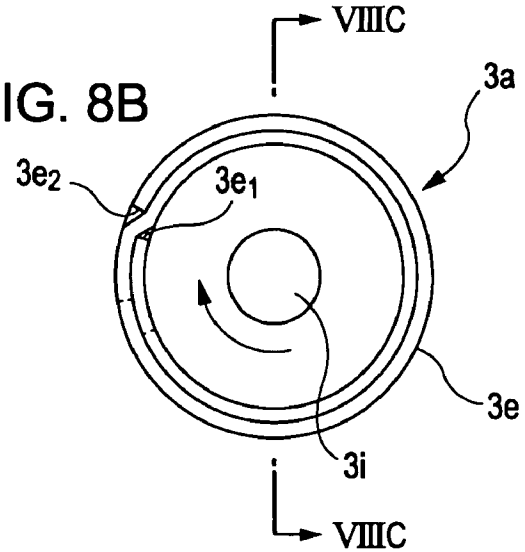
FIGS. 8A to 8C are schematic diagrams of the right end of a charge roller according to another embodiment of the invention.
Figure 8A:
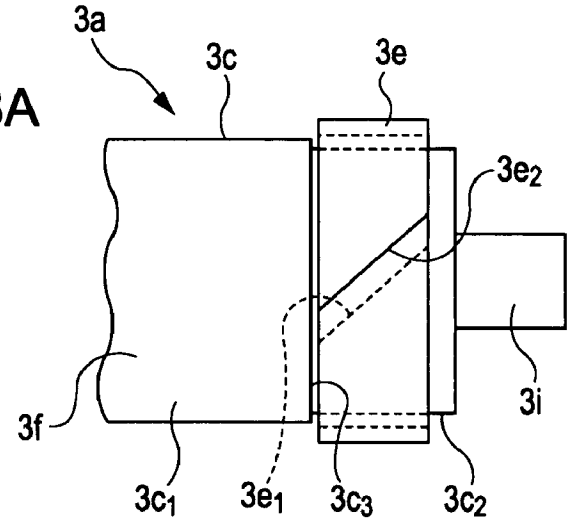
Figure 8C:
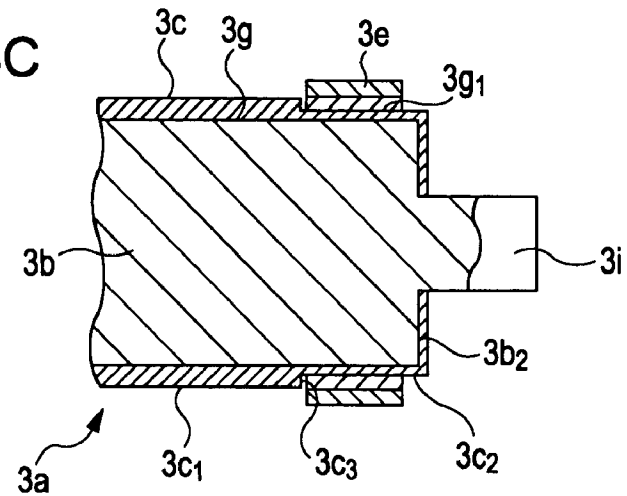

FIGS. 8A to 8C are schematic diagrams, similar to FIGS. 3A to 3C, of a charge roller of an image-forming apparatus according to another embodiment of the invention. FIG. 8A is a partial front view of the charge roller. FIG. 8B is a right side view of the charge roller. FIG. 8C is a sectional view taken along line VIIIC-VIIIC of FIG. 8B.

In the embodiment shown in FIGS. 6A to 6B, the core 3*b* has the beveled portion $3b_3$, and the resistive layer 3*c* is formed of a conductive coating with a uniform thickness and covers the circumferential surface 3*g*, beveled portion $3b_3$, and right end surface $3b_2$ of the core 3*b*. In this embodiment, as shown in FIGS. 8A to 8C, the beveled portion $3b_3$ is not formed on the core 3*b*, and the resistive layer 3*c* is formed of a conductive coating that is thicker on the charging portion 3*f* of the circumferential surface 3*g* of the core 3*b* and is thinner at the right end of the circumferential surface 3*g* of the core 3*b*, including the area where the gap member 3*e* is fixed and the right end surface $3b_2$.

That is, the resistive layer 3*c* has a large-diameter portion $3c_1$ that is thicker and corresponds to the charging portion 3*f*, a small-diameter portion $3c_2$ that is thinner and corresponds to the area where the gap member 3*e* is fixed, and an annular step $3c_3$ between the large-diameter portion $3c_1$ and the small-diameter portion $3c_2$. The left side of the core 3*b* and the resistive layer 3*c* and the left gap member 3*d* are similar to but symmetrical with the right side of the core 3*b* and the resistive layer 3*c* and the right gap member 3*e*. That is, the small-diameter portions of the left and right ends of the resistive layer 3*c* are thinner and correspond to the areas where the gap members 3*d* and 3*e* are fixed, and the large-diameter portion $3c_1$ between the left and right ends of the resistive layer 3*c* is thicker than the small-diameter portions. The gap members 3*d* and 3*e* are fixed to the small-diameter portions of the left and right ends of the resistive layer 3*c*.

A method for producing the charge roller 3*a* according to this embodiment will be described.

FIGS. 9A to 9E are diagrams illustrating the method for producing the charge roller 3*a*. FIGS. 9A to 9E illustrate only the right side of the charge roller 3*a*, and the left side thereof is not illustrated, as in FIGS. 4A to 4E. Reference numerals in parentheses indicate components on the right side of the charge roller 3*a*.

Figure 9A:
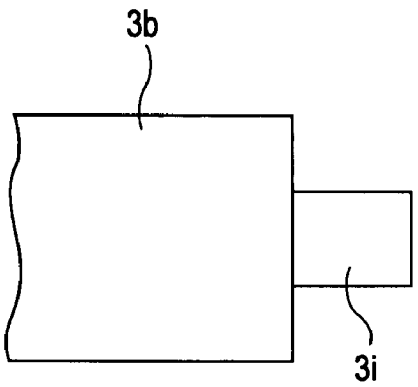
FIGS. 9A to 9E are diagrams illustrating a method for producing the charge roller shown in FIGS. 8A to 8C.
Figure 9B:
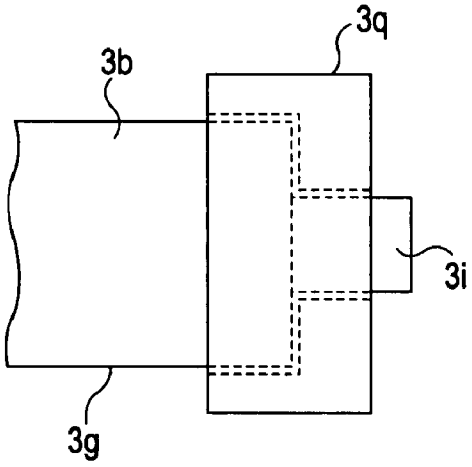
Figure 9C:
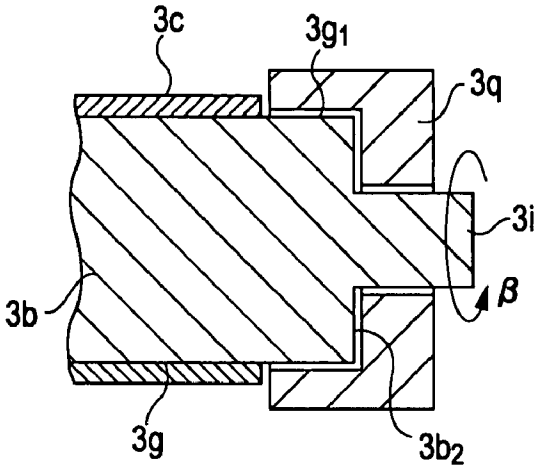

Referring to FIG. 9A, first, the core 3*b* is prepared. This core 3*b* has the rotating shafts (3*i*) at both ends thereof and is formed of a metal shaft having a predetermined length and a predetermined diameter. Referring to FIG. 9B, a pair of masking/bearing members (3*q*) are provided so as to cover the circumferential surfaces $3g_1$ of the left and right ends of the core 3*b*, the left and right end surfaces ($3b_2$), and parts of the rotating shafts (3*i*) adjacent to the core 3*b* and rotatably support the rotating shafts (3*i*). Referring to FIG. 9C, the thicker portion of the resistive layer 3*c*, namely, the large-diameter portion $3c_1$, is formed between the left and right ends of the core 3*b* by applying a conductive coating material to a portion of the circumferential surface 3*g* which is not covered by the masking/bearing members (3*q*) to a relatively large predetermined thickness while rotating the charge roller 3*a* in, for example, the β direction. The coating may be performed either by a dry process or by a wet process. After the coating is completed, the core 3*b* is removed from the masking/bearing members (3*q*).

Figure 9D:
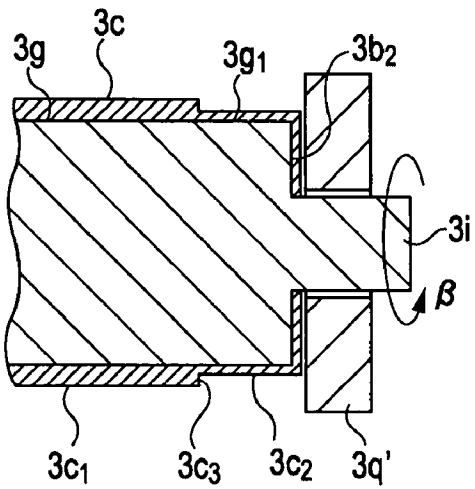

Referring to FIG. 9D, a pair of second masking/bearing members (3*q*') are provided so as to rotatably support the rotating shafts (3*i*). These second masking/bearing members (3*q*') are separated from the left and right end surfaces ($3b_2$) of the core 3*b* by a predetermined distance to define predetermined gaps between end surfaces of the second masking/bearing members (3*q*') and the left and right end surfaces ($3b_2$) of the core 3*b*. The thinner portions of the resistive layer 3*c* are formed at the left and right ends of the core 3*b* by applying a conductive coating material to the left and right end surfaces ($3b_2$) and the circumferential surfaces $3g_1$, which are not covered by the second masking/bearing members (3*q*') or the thicker portion of the resistive layer 3*c*, to a thickness smaller than that of the thicker portion while rotating the charge roller 3*a* in, for example, the β direction. The thinner portions of the resistive layer 3*c* correspond to the small-diameter portions ($3c_2$). The annular steps ($3c_3$) are formed between the large-diameter portion $3c_1$ and the small-diameter portions ($3c_2$).

Figure 9E:
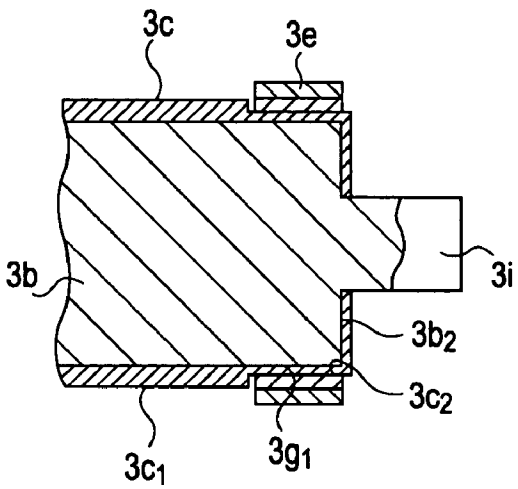

Referring to FIG. 9E, finally, tape-shaped films having ends cut obliquely with a predetermined width are prepared. As described above, one of the ends of each film is fixed to the corresponding small-diameter portion ($3c_2$) of the resistive layer 3*c* by adhesion or bonding. The films are then wound around the small-diameter portions ($3c_2$) of the resistive layer 3*c* by one turn in the direction opposite the rotational direction α of the charge roller 3*a* in use and perpendicular to the axial direction of the charge roller 3*a*. The films are further wound around the first layers of the films and are fixed by adhesion or bonding. Thus, the charge roller 3*a* is completed.

The resistive layer 3*c* may be formed by other methods so as to vary in thickness. For example, the small-diameter portions ($3c_2$) may be formed by applying a conductive coating material to the overall circumferential surface of the core 3*b* before the large-diameter portion $3c_1$ is formed by masking areas of the coating where the gap members 3*d* and 3*e* are to be fixed and applying the coating material to an exposed portion of the coating.

The left and right edges of the core 3*b*, which are not beveled in this embodiment, may also be beveled as in the embodiments above.

In this embodiment, the charge roller 3*a* has the small-diameter portions at the left and right ends thereof, where the gap members 3*d* and 3*e* are fixed. The diameter of the small-diameter portions can be appropriately adjusted so that the desired charge gap G can easily be defined at low cost using commercially available films having the thickness corresponding to the charge gap G.

The rest of the structure and the other operations and advantages of the image-forming apparatus 1 and the charge roller 3*a* according to this embodiment are the same as those of the embodiments shown in FIGS. 1, 2, and 6A to 6C. The resistive layer 3*c* may be formed of an elastic conductive rubber film having a predetermined width, rather than the inelastic conductive coating described above. In addition, each of the films of the gap members 3*d* and 3*e* is wound by slightly less than n turns (wherein n≧2) to form n layers extending in the axial direction at every position in the circumferential direction of the charge roller 3*a*.

Figure 10B:
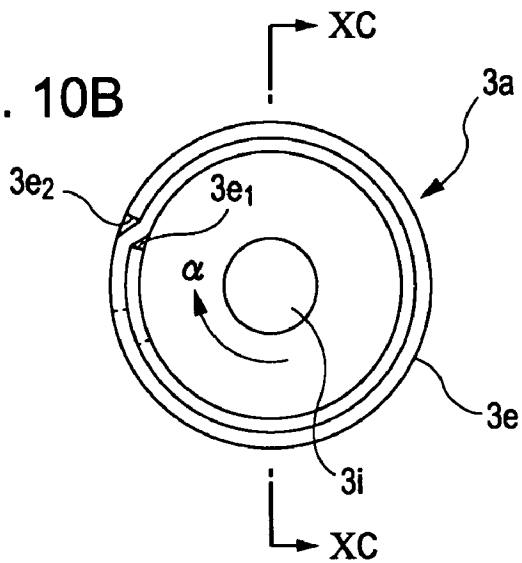
FIGS. 10A to 10C are schematic diagrams of the right end of a charge roller according to another embodiment of the invention.
Figure 10A:
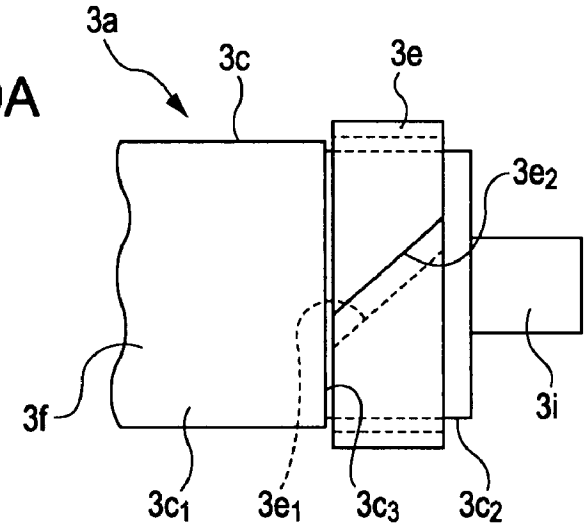
Figure 10C:
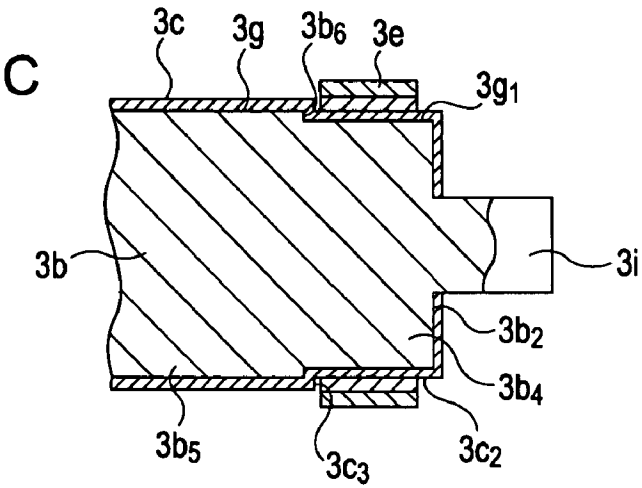

FIGS. 10A to 10C are schematic diagrams, similar to FIGS. 3A to 3C, of a charge roller of an image-forming apparatus according to another embodiment of the invention. FIG. 10A is a partial front view of the charge roller. FIG. 10B is a right side view of the charge roller. FIG. 10C is a sectional view taken along line XC-XC of FIG. 10B. Reference numerals in parentheses indicate components on the right side of the charge roller.

In the embodiment shown in FIGS. 8A to 8B, the core 3*b* has a uniform diameter, and the resistive layer 3*c* is formed on the core 3*b* so as to vary in thickness. In this embodiment, as shown in FIGS. 10A to 10C, the core 3*b* includes small-diameter portions ($3b_4$) at the left and right ends thereof, a large-diameter portion $3b_5$ between the left and right ends thereof, and steps ($3b_6$) between the small-diameter portions ($3b_4$) and the large-diameter portion $3b_5$. The resistive layer 3*c* is formed on the left and right small-diameter portions ($3b_4$), large-diameter portion $3b_5$, and left and right end surfaces ($3b_2$) of the core 3*b* so as to have a substantially uniform thickness. Accordingly, the resistive layer 3*c* includes small-diameter portions ($3c_2$) at the left and right ends thereof, a large-diameter portion $3c_1$ between the left and right ends thereof, and steps ($3c_3$) between the small-diameter portions ($3c_2$) and the large-diameter portion $3c_1$. The gap members 3*d* and 3*e* are fixed to the small-diameter portions ($3c_2$) of the left and right ends of the resistive layer 3*c*.

A method for producing the charge roller 3*a* according to this embodiment will be described.

Figure 11A:
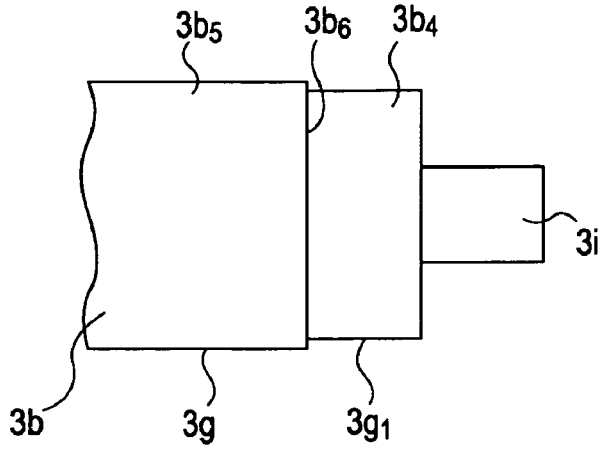
FIGS. 11A to 11C are diagrams illustrating a method for producing the charge roller shown in FIGS. 10A to 10C.
Figure 11B:
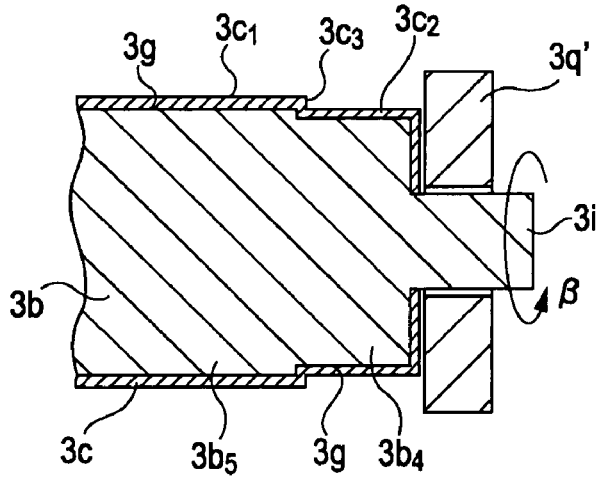
Figure 11C:
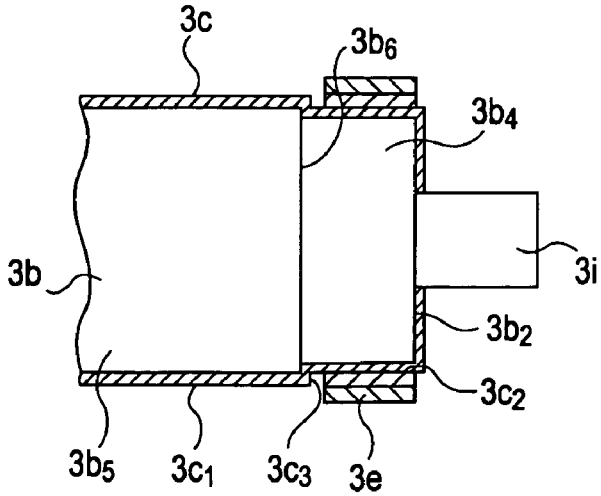

FIGS. 11A to 11C are diagrams illustrating the method for producing the charge roller 3*a*. FIGS. 11A to 11C illustrate only the right side of the charge roller 3*a*, as in FIGS. 4A to 4E, and the left side thereof is not illustrated.

Referring to FIG. 11A, first, the core 3*b* is prepared. This core 3*b* has the rotating shafts (3*i*) at both ends thereof and is formed of a metal shaft having a predetermined length. The core 3*b* includes the small-diameter portions ($3b_4$) at the left and right ends thereof, the large-diameter portion $3b_5$ between the left and right ends thereof, and the steps ($3b_6$) between the small-diameter portions ($3b_4$) and the large-diameter portion $3b_5$. Referring to FIG. 11B, a pair of second masking/bearing members (3*q*') are provided so as to rotatably support the rotating shafts (3*i*). These second masking/bearing members (3*q*') are separated from the left and right end surfaces ($3b_2$) of the core 3*b* by a predetermined distance to define predetermined gaps between end surfaces of the second masking/bearing members (3*q*') and the left and right end surfaces ($3b_2$) of the core 3*b*. The resistive layer 3*c* is formed by applying a conductive coating material to the left and right end surfaces ($3b_2$), large-diameter portion $3b_4$, and small-diameter portions ($3b_5$) of the core 3*b* while rotating the charge roller 3*a* in, for example, the β direction. The resistive layer 3*c* includes the small-diameter portions ($3c_2$) at the left and right ends thereof, the large-diameter portion $3c_1$, and the annular steps ($3c_3$) between the small-diameter portions ($3c_2$) and the large-diameter portion $3c_1$.

Referring to FIG. 11C, finally, tape-shaped films having ends cut obliquely with a predetermined width are prepared. As described above, one of the ends of each film is fixed to the corresponding small-diameter portion ($3c_2$) of the resistive layer 3*c* by adhesion or bonding. The films are then wound around the small-diameter portions ($3c_2$) by one turn in the direction opposite the rotational direction a of the charge roller 3*a* in use and perpendicular to the axial direction of the charge roller 3*a*. The films are further wound around the first layers of the films and are fixed by adhesion or bonding. Thus, the charge roller 3*a* is completed.

The rest of the structure and the other operations and advantages of the image-forming apparatus 1 and the charge roller 3*a* according to this embodiment are the same as those of the embodiments shown in FIGS. 1, 2, and 8A-8C. The resistive layer 3*c* may be formed of an elastic conductive rubber film having a predetermined width, rather than the inelastic conductive coating described above. In addition, each of the films of the gap members 3*d* and 3*e* is wound by slightly less than n turns (wherein n≧2) to form n layers extending in the axial direction at every position in the circumferential direction of the charge roller 3*a*.

Figure 12:
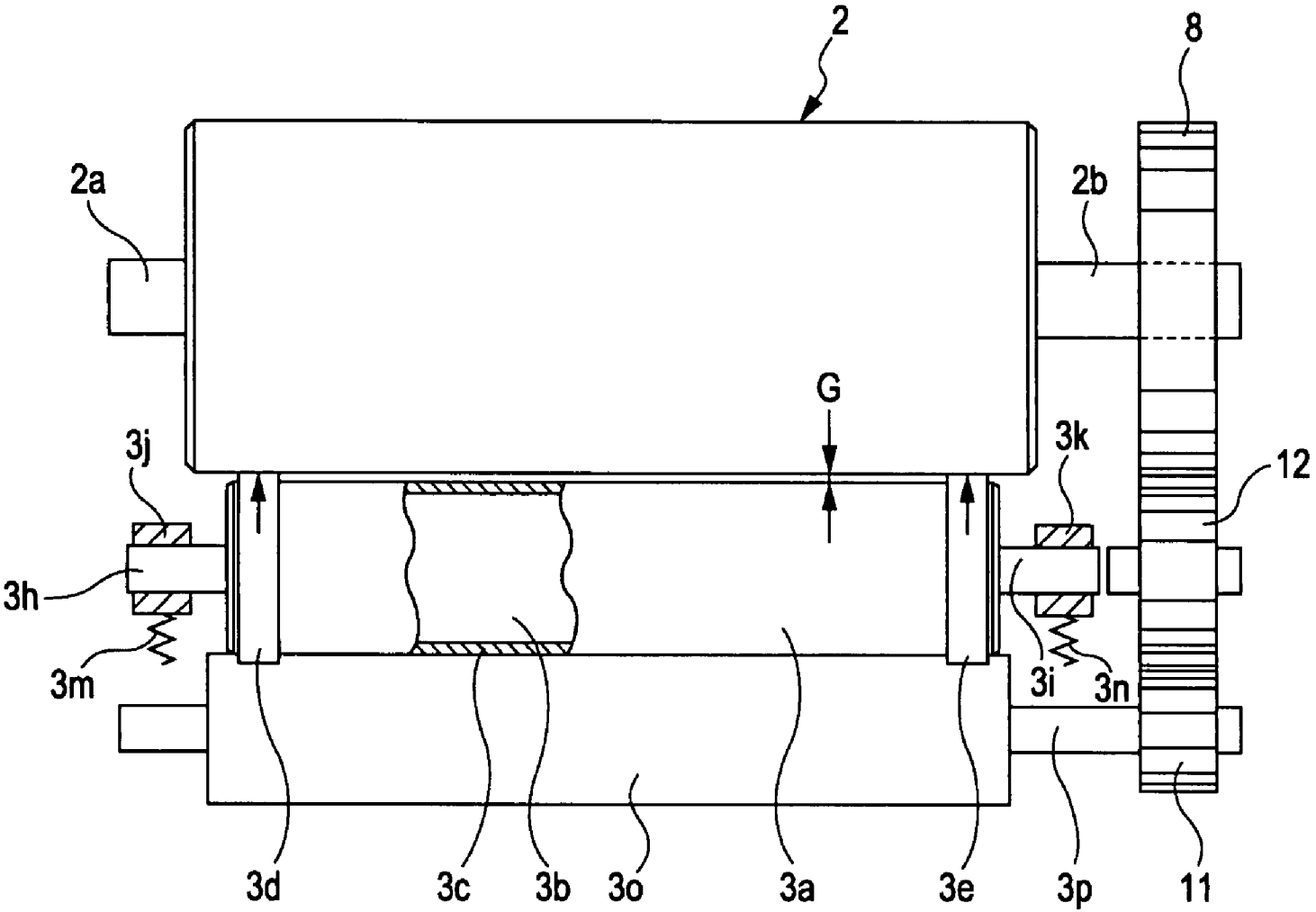
FIG. 12 is a schematic diagram of a photosensitive member, a charge roller, and a cleaning member used in an image-forming apparatus according to another embodiment of the invention.

In the image-forming apparatus 1 according to each of the embodiments described above, as shown in FIG. 2, the drive gear 9 for driving the charge roller 3*a* is driven by the drive gear 8 for driving the photosensitive member 2 to directly rotate the charge roller 3*a*, although the invention is not limited to that driving mechanism. For example, the charge roller 3*a* may be rotated by friction with the photosensitive member 2 and the cleaning member 3*o*. Referring to FIG. 12, specifically, a drive gear 11 for driving the cleaning member 3*o* is fixed to a right rotating shaft 3*p* of the cleaning member 3*o*. The drive gears 8 and 11 are coupled by an intermediate gear 12 rotatably supported by the main body of the apparatus 1. The drive gear 8, as described above, transmits a driving force produced by a motor to the photosensitive member 2 to rotate the photosensitive member 2. The driving force is also transmitted to the drive gear 11 via the intermediate gear 12 to rotate the cleaning member 3*o*. The charge roller 3*a* is pressed between the photosensitive member 2 and the cleaning member 3*o* so that the charge roller 3*a* is rotated by friction therebetween as the photosensitive member 2 and the cleaning member 3*o* rotate.

If the films are wound in layers to form the gap members 8*d* and 8*e* as described above, the photosensitive member 2 suffers from discharge during noncontact charging using a superimposed bias containing DC and AC voltage components. The discharge decreases the thickness of the charged portion of the photosensitive member 2 with increasing number of prints. In the embodiments of the invention, the circumferential speeds of the photosensitive member 2 and the charge roller 3*a* may be controlled to a predetermined circumferential speed ratio. If the photosensitive member 2 and the charge roller 3*a* are rotated at different circumferential speeds, friction occurs between the gap members 3*d* and 3*e* and portions of the photosensitive member 2 which come into contact with the gap members 3*d* and 3*e*.

While the thickness of the charged portion decreases after a large number of prints, friction with the gap members 3*d* and 3*e* decreases the thickness of the portions which come into contact therewith, thus reducing the difference in thickness between the charged portion and the portions which come into contact the gap members 3*d* and 3*e*. The charge gap G can therefore be maintained at a predetermined width or less to perform stable, excellent charging of the photosensitive member 2. The photosensitive member 2 and the charge roller 3*a* can thus be rotated at different circumferential speeds to prolong the life of the photosensitive member 2.

Next, experiments conducted on examples belonging to the invention and comparative examples that do not belong to the invention will be described to demonstrate the operations and advantages of the charge roller 3*a* and the image-forming apparatus 1 described above. These experiments include a first set of experiments where the photosensitive member 2 and the charge roller 3*a* were rotated at a circumferential speed ratio of 1 (including ratios of substantially 1 because the ratio is difficult to precisely adjust to 1) and a second set of experiments where the photosensitive member 2 and the charge roller 3*a* were rotated at substantially different circumferential speeds. The image-forming apparatus used in each experiment was a commercially available printer, LP-9000C, manufactured by Seiko Epson Corporation. This printer was partially modified by replacing its original scorotron charge unit with a noncontact charge unit and providing an external power supply for applying an AC voltage to the charge unit. The replacement parts used, including toner, a photosensitive member, a transfer unit, and a fusing unit, were original parts of the printer LP-9000C.

The first set of experiments will be described. The first set of experiments relates to the peeling of the films of the gap members 3*d* and 3*e* and includes ten experiments, namely, Experiment Nos. 1 to 10. Table 1 shows the types of charge rollers and gap members of image-forming apparatuses used in Experiment Nos. 1 to 10.

TABLE 1

| No. | Charge roller | Gap member | Type of film |
|---|---|---|---|
| 1 | Metal shaft + conductive coating (inelastic) | Double-layer winding<br>Oblique cut<br>G: 30 μm | Polyester tape<br>Manufactured by Sumitomo 3M Limited<br>No. 9391 (thickness: 22 μm) |
| 2 | Metal shaft + conductive rubber (elastic) | Double-layer winding<br>Oblique cut<br>G: 32 μm | Polyester tape<br>Manufactured by Sumitomo 3M Limited<br>No. 9391 (thickness: 22 μm) |

TABLE 1-continued

| No. | Charge roller | Gap member | Type of film |
|---|---|---|---|
| 3 | Metal shaft + conductive coating (inelastic) | Spiral winding by slightly more than one turn G: 50 μm | Polyester tape Manufactured by Sumitomo 3M Limited No. 9390 (thickness: 50 μm) |
| 4 | Metal shaft + conductive rubber (elastic) | Spiral winding by slightly more than one turn G: 50 μm | Polyester tape Manufactured by Sumitomo 3M Limited No. 9390 (thickness: 50 μm) |
| 5 | Metal shaft + conductive coating (inelastic) | Single-layer winding Oblique cut G: 50 μm | Polyester tape Manufactured by Sumitomo 3M Limited No. 9390 (thickness: 50 μm) |
| 6 | Metal shaft + conductive rubber (elastic) | Single-layer winding Oblique cut G: 50 μm | Polyester tape Manufactured by Sumitomo 3M Limited No. 9390 (thickness: 50 μm) |
| 7 | Metal shaft + conductive coating (inelastic) | Spiral winding by slightly more than one turn G: 35 μm | Kapton ® film tape Manufactured by Teraoka Seisakusho Co., Ltd. No. 650S (#12) (thickness: 35 μm) |
| 8 | Metal shaft + conductive rubber (elastic) | Spiral winding by slightly more than one turn G: 35 μm | Kapton ® film tape Manufactured by Teraoka Seisakusho Co., Ltd. No. 650S (#12) (thickness: 35 μm) |
| 9 | Metal shaft + conductive coating (inelastic) | Triple-layer winding Oblique cut G: 45 μm | Kapton ® film tape Manufactured by Teraoka Seisakusho Co., Ltd. No. 650S (#12) (thickness: 35 μm) |
| 10 | Metal shaft + conductive rubber (elastic) | Triple-layer winding Oblique cut G: 45 μm | Kapton ® film tape Manufactured by Teraoka Seisakusho Co., Ltd. No. 650S (#12) (thickness: 35 μm) |

The photosensitive member 2 used in Experiment Nos. 1 to 10 was the original photosensitive member of the printer LP-9000C. This photosensitive member was composed of an aluminum pipe coated with an organic photosensitive material to form a photosensitive layer and had a runout accuracy of not more than 0.01.

The charge unit 3 used instead of the scorotron charge unit of the printer LP-9000C was a noncontact charge unit including the charge roller 3*a*. This charging unit was produced so that it could be mounted on the printer LP-9000C. FIGS. 13A to 13H show types of charge rollers used in the experiments. FIGS. 13B, 13D, 13F, and 13H are sectional views, similar to FIG. 3C, of FIGS. 13A, 13C, 13E, and 13G, respectively.

The charge roller 3*a* used in Experiment Nos. 1 to 10 included a nickel-plated SUM22 shaft having a diameter of 10 mm as the core 3*b*. This metal shaft was formed in such a shape that it could be mounted on the modified printer described above.

Figure 13A:
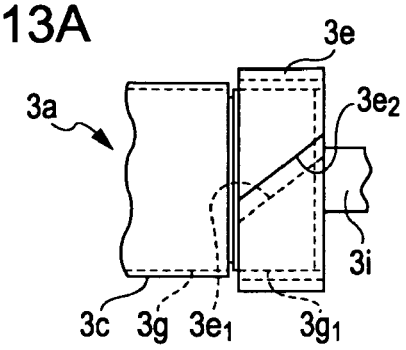
FIGS. 13A to 13H are schematic diagrams of the right ends of charge rollers used in experiments.
Figure 13B:
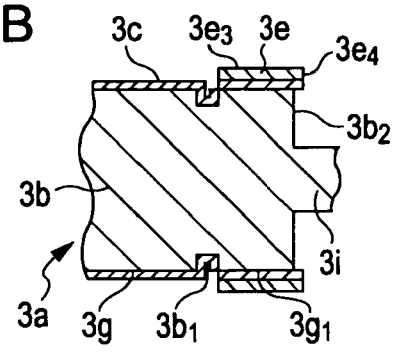

The core 3*b* used in Experiment Nos. 1 and 2, as shown in FIGS. 13A and 13B, was similar to that shown in FIGS. 3A to 3C, that is, had annular grooves similar to those shown in FIGS. 3A to 3C at both ends thereof. Also, the core 3*b* used in Experiment Nos. 9 and 10, as shown in FIGS. 13G and 13H, had annular grooves similar to those shown in FIGS. 3A to 3C (or FIGS. 5A to 5C) at both ends thereof. These annular grooves had a width of 1 mm and a depth of 0.2 mm. The portions of the circumferential surface 3*g* of the core 3*b* where the gap members 3*d* and 3*e* were to be fixed outside the annular grooves had a width of 4 mm (the length in the axial direction of the charge roller 3*a*).

Figure 13C:
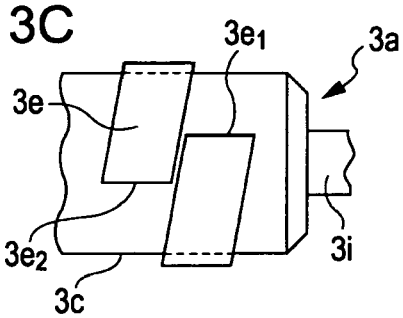
Figure 13D:
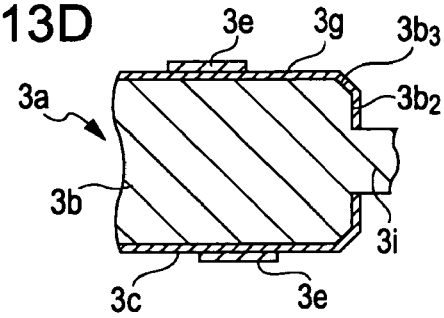
Figure 13E:
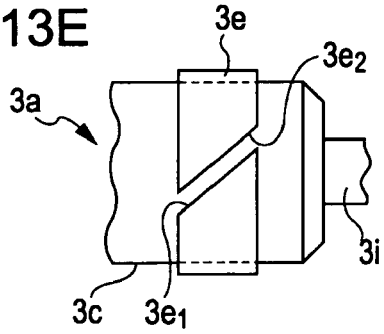
Figure 13F:
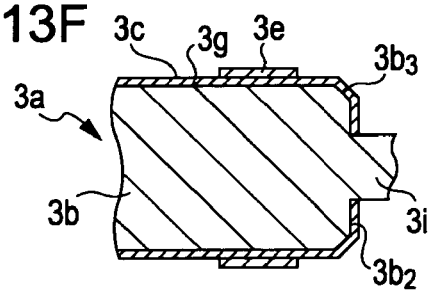
Figure 13G:
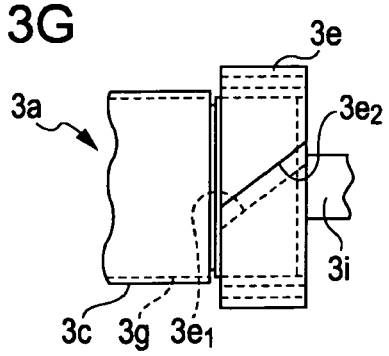
Figure 13H:
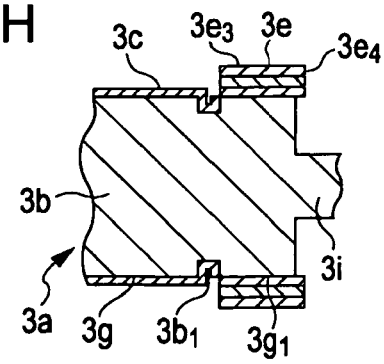

The core 3*b* used in Experiment Nos. 3 and 4, as shown in FIGS. 13C and 13D, was similar to that shown in FIGS. 6A to 6C, that is, had beveled portions similar to those shown in FIGS. 6A to 6C at both edges thereof. Also, the core 3*b* used in Experiment Nos. 7 and 8, as shown in FIGS. 13E and 13F, had beveled portions similar to those shown in FIGS. 6A to 6C at both edges thereof. The beveled portions had a width of about 2 mm.

In each of Experiment Nos. 1 to 10, the core 3*b* had the rotating shafts 3*h* and 3*i* at the ends thereof, and the metal shaft used therefor was processed to a runout accuracy of not more than 0.01 by centerless polishing.

The resistive layer 3*c* was formed on the metal shaft of the charge roller 3*a* used in each experiment. The resistive layer 3*c* used in Experiment Nos. 1, 2, 9, and 10, as shown in FIGS. 13A, 13B, 13G, and 13H, was similar to that shown in FIGS. 3A to 3C, that is, was formed on the portion of the circumferential surface of the metal shaft corresponding to the charging portion 3*f* and in the annular grooves of the metal shaft. The resistive layer 3*c* used in Experiment Nos. 3 to 8, as shown in FIGS. 13C to 13F, was similar to that shown in FIGS. 6A to 6C, that is, was formed on the circumferential surface, beveled portions, and end surfaces of the metal shaft except for the rotating shaft 3*h* and 3*i*.

In Experiment Nos. 1, 3, 5, 7, and 9, the resistive layer 3*c* was composed of a conductive layer formed by spraying a coating liquid prepared by mixing conductive tin oxide ($SnO_2$) and polyurethane (PU) in a weight ratio of 1:9 and dispersing the mixture in water containing an ionically conductive material. Table 2 shows conductive $SnO_2$ products available from Jemco Inc., as detailed in its home page.

TABLE 2

| Name | Physical properties | Application |
|---|---|---|
| Sn—Sb oxides Trade name: T-1 | (1) Form: Blue gray powder (2) Powder resistivity: 1-3 Ω · cm (under pressure of 100 kg/cm$^2$) (3) Particle shape: Spherical | Antistatic agent A transparent thin conductive film can be formed because the particle size is smaller than visible light wavelengths. |

TABLE 2-continued

| Name | Physical properties | Application |
|---|---|---|
| | (4) Primary particle size: 0.02 μm<br>(5) Specific gravity: 6.6 | |
| Sn—Sb oxide aqueous dispersion<br>Trade name: TDL | (1) Form: Blue liquid (aqueous)<br>(2) Solid content: 17 wt %<br>(3) Solid content average particle size: 100 nm<br>(4) Specific gravity: 1.17 | Antistatic agent<br>This is an aqueous dispersion of tin oxide doped with antimony oxide. It can form a transparent conductive film. |
| Sn—Sb oxide paint/dispersion<br>Trade name: ES | (1) Form: Blue liquid<br>(2) Coating surface resistance (measured by Jemco Inc.): $10^{6-9}$ Ω/square | (1) Antistatic agent<br>(2) Near infrared shield<br>A highly transparent thin conductive film and a near infrared shield film can be formed because the size of particles contained in the paint is smaller than visible light wavelengths. |
| $TiO_2$/Sn—Sb oxides<br>Trade name: W-1 | (1) Form: Gray white powder<br>(2) Powder resistivity: 3-10 Ω · cm (under pressure of 100 kg/cm$^2$)<br>(3) Particle shape: Spherical<br>(4) Primary particle size: 0.2 μm<br>(5) Specific gravity: 4.6 | Antistatic agent<br>This is a white conductive material that can be colored by mixing a resin. |

The conductive $SnO_2$ used in the examples and the comparative examples was "T-1" (a trade name of Jemco Inc.), which is tin-antimony oxide, although other types of conductive $SnO_2$ may also be used. The ionically conductive material was used to provide conductivity for the coating material. The ionically conductive material used in the examples and the comparative examples was "YYP-12" (manufactured by Marubishi Oil Chemical Co., Ltd.).

The thickness of the charging portion 3*f* of the charge roller 3*a* was adjusted according to the thickness and number of turns of the films of the gap members 3*d* and 3*e* so as to define the gaps G shown in Table 1 (described later in detail). When the coating liquid used in the experiments was applied onto an aluminum plate to form a film having a thickness of 20 μm, its volume resistivity was measured to be 1.0 to $5.0\times10^{10}$ Ω·cm.

In Experiment Nos. 2, 4, 6, 8, and 10, the resistive layer 3*c* was formed of a conductive rubber. The conductive rubber used was a 166-series rubber manufactured by Hokushin Corporation (rubber hardness: 48° in terms of JIS-A). The thickness of the charging portion 3*f* of the charge roller 3*a* was adjusted according to the thickness and number of turns of the films of the gap members 3*d* and 3*e* so as to define the gaps G shown in Table 1 (described later in detail). Charge rollers having conductive rubber layers with the thicknesses described above were outsourced from Hokushin Corporation.

In Experiment Nos. 1 and 2, the gap members 3*d* and 3*e* were formed of polyester tapes manufactured by Sumitomo 3M Limited (No. 9391; thickness: 22 μm; width: 5 mm). In Experiment Nos. 3 to 6, the gap members 3*d* and 3*e* were formed of polyester tapes manufactured by Sumitomo 3M Limited (No. 9390; thickness: 50 μm; width: 5 mm). In Experiment Nos. 7 to 10, the gap members 3*d* and 3*e* were formed of Kapton® film tapes manufactured by Teraoka Seisakusho Co., Ltd. (No. 650S(#12); thickness: 35 μm; width: 5 mm).

In Experiment Nos. 1 and 2, as shown in FIGS. 13A and 13B, the gap members 3*d* and 3*e* were formed by cutting the ends of the polyester tapes obliquely at 45° with respect to the longitudinal direction thereof, winding the tapes in layers by slightly less than two turns (with the ends thereof separated from each other in the circumferential direction), and fixing the tapes by adhesion. In Experiment Nos. 3 and 4, as shown in FIGS. 13C and 13D, the gap members 3*d* and 3*e* were formed by spirally winding the polyester tapes by slightly more than one turn with the ends thereof aligned in parallel in the axial direction of the charge roller, and fixing the tapes by adhesion. The tapes were wound by slightly more than one turn such that the trailing ends thereof were shifted from the beginning ends in the axial direction so as not to overlap with the beginning ends and were positioned beyond the beginning ends in the circumferential direction. In Experiment Nos. 5 and 6, as shown in FIGS. 13E and 13F, the gap members 3*d* and 3*e* were formed by cutting the ends of the polyester tapes obliquely at 45° with respect to the longitudinal direction thereof, winding the tapes by slightly less than one turn (with the ends thereof separated from each other in the circumferential direction), and fixing the tapes by adhesion. In Experiment Nos. 7 and 8, as shown in FIGS. 13C and 13D, the gap members 3*d* and 3*e* were formed by spirally winding the Kapton® film tapes by slightly more than one turn with the ends thereof aligned in parallel in the axial direction of the charge roller, and fixing the tapes by adhesion. The tapes were wound by slightly more than one turn such that the trailing ends thereof were shifted from the beginning ends in the axial direction so as not to overlap with the beginning ends and were positioned beyond the beginning ends in the circumferential direction. In Experiment Nos. 9 and 10, as shown in FIGS. 13G and 13H, the gap members 3*d* and 3*e* were formed by cutting the ends of the polyester tapes obliquely at 45° with respect to the longitudinal direction thereof, winding the tapes in layers by slightly less than three turns (with the ends thereof separated from each other in the circumferential direction), and fixing the tapes by adhesion. In Experiment Nos. 1, 2, 9, and 10, the tapes were fixed to the core 3*b* so as to protrude to the annular grooves by a length of 0.5 mm and also protrude outward beyond the end surfaces of the core 3*b* in the axial direction by the same length.

The width of the charge gap G was adjusted to 30 μm in Experiment No. 1, 32 μm in Experiment No. 2, 50 μm in Experiment Nos. 3 to 6, 35 μm in Experiment Nos. 7 and 8, and 45 μm in Experiment Nos. 9 and 10. The charge gap G was defined by adjusting the thickness of the resistive layer 3*c* according to the thickness of the gap members 3*d* and 3*e*, that is, the thickness and number of turns of the tapes.

As is obvious from the description above, Experiment Nos. 1, 2, 9, and 10 are examples of the invention, and Experiment Nos. 3 to 8 are comparative examples.

In each experiment, the charge roller 3*a* was pressed against the photosensitive member 2 by applying the load of the compression springs 3*m* and 3*n* to the bearings 3*j* and 3*k* (at a distance of 10 mm outward from the gap members 3*d* and 3*e*, respectively). The charge roller 3*a*, which was positioned below the photosensitive member 2 in the image-forming apparatus used in the experiments, was pressed against the photosensitive member 2 by applying a spring load of 300 gf in any of Experiment Nos. 1 to 10.

In each experiment, the cleaning member 3*o* was pressed against the charge roller 3*a*, as shown in FIG. 2. The cleaning member 3*o* used was a sponge roller (trade name: "Real Sealer"; manufactured by Bridgestone Kaseihin Tokyo Co., Ltd.). This sponge roller had an outer diameter of 10 mm. The depth of the contact of the sponge roller with the charge roller 3*a* was adjusted to 0.5 mm so that the pressure of the cleaning member 3*o* on the charge roller 3*a* was significantly smaller than that of the charge roller 3*a* on the photosensitive member 2. The cleaning member 3*o* was thus used to remove foreign matter such as toner and additives deposited on the charge roller 3*a*.

In each experiment, the charge roller 3*a* and the cleaning member 3*o* were directly driven as shown in FIG. 2.

In the image formation of the experiments, the photosensitive member 2 and the cleaning member 3*o* were rotated clockwise in FIG. 1, and the charge roller 3*a* was rotated counterclockwise in FIG. 1. The photosensitive member 2 and the charge roller 3*a* were rotated at substantially the same circumferential speed, namely, about 210 mm/s, in each experiment.

In each experiment, the voltage $V_c$ (V) applied to the charge roller 3*a* contained a DC voltage component $V_{DC}$ (V) and an AC voltage component $V_{AC}$ (V), as represented by the following equation:

$$V_C=V_{DC}+V_{AC}=-650+(1/2)V_{pp}\cdot\sin 2\pi ft$$

(where $V_{pp}$=1,700 V, f=1.3 kHz, and $V_{AC}$ is a sine wave). The bias voltage used for development contained a DC voltage component ($V_{DC}$=−200 V) and an AC voltage component having a rectangular waveform ($V_{pp}$=1,400 V and f=3.0 kHz). Monochrome halftone printing (print density: 25%; full-page solid image) was performed on A4 normal paper in room environment, namely, at a temperature of 23° C. and a humidity of 60%.

The printed paper was sampled and evaluated by visual observation after 50, 100, 500, 1,000, and 5,000 prints. Table 3 shows the evaluation results. If no print error occurred after 5,000 prints, the charging was determined to be acceptable. If a print error occurred before 5,000 prints, the charging was determined to be unacceptable.

TABLE 3

| No. | Charge roller | Gap member | Evaluation | Remarks |
|---|---|---|---|---|
| 1 | Metal shaft + conductive coating (inelastic) | Double-layer winding Oblique cut | Acceptable | No tape peeling occurred after 5,000 prints |
| 2 | Metal shaft + conductive rubber (elastic) | Double-layer winding Oblique cut | Acceptable | No tape peeling occurred after 5,000 prints |
| 3 | Metal shaft + conductive coating (inelastic) | Spiral winding by slightly more than one turn | Unacceptable | Tape peeling occurred after 322 prints |
| 4 | Metal shaft + conductive rubber (elastic) | Spiral winding by slightly more than one turn | Unacceptable | Tape peeling occurred after 455 prints |
| 5 | Metal shaft + conductive coating (inelastic) | Single-layer winding Oblique cut | Unacceptable | Tape peeling occurred after 233 prints |
| 6 | Metal shaft + conductive rubber (elastic) | Single-layer winding Oblique cut | Unacceptable | Tape peeling occurred after 451 prints |
| 7 | Metal shaft + conductive coating (inelastic) | Spiral winding by slightly more than one turn | Unacceptable | Tape peeling occurred after 231 prints |
| 8 | Metal shaft + conductive rubber (elastic) | Spiral winding by slightly more than one turn | Unacceptable | Tape peeling occurred after 711 prints |
| 9 | Metal shaft + conductive coating (inelastic) | Triple-layer winding Oblique cut | Acceptable | No tape peeling occurred after 5,000 prints |
| 10 | Metal shaft + conductive rubber (elastic) | Triple-layer winding Oblique cut | Acceptable | No tape peeling occurred after 5,000 prints |

In Table 3, the examples of the invention, that is, Experiment Nos. 1, 2, 9, and 10, were determined to be acceptable because excellent charging could be performed without print errors such as peeling of the films (tapes). On the other hand, print errors occurred after 322 prints in Experiment No. 3, after 455 prints in Experiment No. 4, after 233 prints in Experiment No. 5, after 451 prints in Experiment No. 6, after 231 prints in Experiment No. 7, and after 711 prints in Experiment No. 8. These comparative examples were determined to be unacceptable because the observation found the peeling of the films at the ends at which the films started entering the contact positions (nips) between the charge roller and the photosensitive member. The peeling resulted from decreased adhesion due to foreign matter, such as toner, deposited at the ends of the films. Consequently, the width of the charge gap G exceeded 50 μm, and charging defects occurred.

These experiments demonstrated that the operations and advantages of the embodiments described above could be achieved in noncontact charging by fixing the ends of the films at which they start entering the nips between the charge roller 3*a* and the photosensitive member 2 to the core 3*b* of the charge roller 3*a* and winding the films in layers by slightly less than two turns in a direction opposite the rotational direction α of the charge roller 3*a* without shifting the films in the axial direction.

The second set of experiments will be described. The second set of experiments relates to the decrease in the thickness of the charged portion of the photosensitive member 2 in the case where the gap members 3*d* and 3*e* are formed by winding the films in layers. The second set of experiments includes six experiments, namely, Experiment Nos. 11 to 16. Table 4 shows the types of charge rollers and gap members used in Experiment Nos. 11 to 16.

TABLE 4

(Circumferential speed of photosensitive member: 210 mm/s)

| No. | Charge roller | Gap member | Type of film | Circumferential speed |
|---|---|---|---|---|
| 11 | Metal shaft + conductive coating (inelastic) | Double-layer winding Oblique cut G: 30 μm | Polyester tape Manufactured by Sumitomo 3M Limited No. 9391 (thickness: 22 μm) | 199.5 mm/s (95%) |
| 12 | Metal shaft + conductive rubber (elastic) | Double-layer winding Oblique cut G: 32 μm | Polyester tape Manufactured by Sumitomo 3M Limited No. 9391 (thickness: 22 μm) | 203.7 mm/s (97%) |
| 13 | Metal shaft + conductive coating (inelastic) | Double-layer winding Oblique cut G: 25 μm | Polyester tape Manufactured by Sumitomo 3M Limited No. 9391 (thickness: 22 μm) | 220.5 mm/s (105%) |
| 14 | Metal shaft + conductive rubber (elastic) | Double-layer winding Oblique cut G: 28 μm | Polyester tape Manufactured by Sumitomo 3M Limited No. 9391 (thickness: 22 μm) | 216.3 mm/s (103%) |
| 15 | Metal shaft + conductive coating (inelastic) | Double-layer winding Oblique cut G: 25 μm | Polyester tape Manufactured by Sumitomo 3M Limited No. 9391 (thickness: 22 μm) | 210 mm/s (100%) |
| 16 | Metal shaft + conductive rubber (elastic) | Double-layer winding Oblique cut G: 28 μm | Polyester tape Manufactured by Sumitomo 3M Limited No. 9391 (thickness: 22 μm) | 210 mm/s (100%) |

As shown in Table 4, the charge rollers used in Experiment Nos. 11 to 16 were of the same type as the charge roller 3*a* shown in FIGS. 13A and 13B. The charge rollers used in Experiment Nos. 11 and 12 were identical to those used in Experiment Nos. 1 and 2, respectively, in the first set of experiments. The charge rollers used in Experiment Nos. 13 and 15 were identical to that used in Experiment No. 11 except that the width of the charge gap G was adjusted to 25 μm. The charge rollers used in Experiment Nos. 14 and 16 were identical to that used in Experiment No. 12 except that the width of the charge gap G was adjusted to 28 μm.

The rotational directions of the photosensitive member 2, the charge roller 3*a*, and the cleaning member 3*o* in the second set of experiments were the same as those in the first set of experiments. The circumferential speed of the photosensitive member 2 was adjusted to 210 mm/s, which was the same as in the first set of experiments. The circumferential speed of the charge roller 3*a* was adjusted to 199.5 mm/s (98% relative to the circumferential speed of the photosensitive member 2) in Experiment No. 11, 203.7 mm/s (97%) in Experiment No. 12, 220.5 mm/s (105%) in Experiment No. 13, 216.3 mm/s (103%) in Experiment No. 14, and 210 mm/s (100%) in Experiment Nos. 15 and 16. Separate power supplies were provided for the photosensitive member 2 and the charge roller 3*a* to rotate them at different circumferential speeds.

For the voltage $V_c$ (V) applied to the charge roller 3*a*, $V_{DC}$=−700 V, $V_{pp}$=1,800 V, f=1.3 kHz, and $V_{AC}$ was a sine wave. The rest of the structure of the image-forming apparatus used and the other image-forming conditions were identical to those in the first set of experiments.

Monochrome halftone printing (print density: 25%; full-page solid image) was performed on A4 normal paper. The other printing conditions were identical to those in the first set of experiments.

The printed paper was visually observed. When the observation found a print error (unevenness) due to abnormal charging, the printing was stopped to determine the number of prints at that time. Table 5 shows the number of prints at the time when a print error occurred.

TABLE 5

(Circumferential speed of photosensitive member: 210 mm/s)

| No. | Charge roller | Gap member | Circumferential speed | Number of prints at the time when print error occurred | Thickness difference | Tape peeling |
|---|---|---|---|---|---|---|
| 11 | Metal shaft + conductive coating (inelastic) | Double-layer winding Oblique cut G: 30 μm | 199.5 mm/s (95%) | 18,000 prints | 3 μm | Not peeled |
| 12 | Metal shaft + conductive rubber (elastic) | Double-layer winding Oblique cut G: 32 μm | 203.7 mm/s (97%) | 16,000 prints | 3 μm | Not peeled |
| 13 | Metal shaft + conductive coating (inelastic) | Double-layer winding Oblique cut G: 25 μm | 220.5 mm/s (105%) | 17,000 prints | 4 μm | Not peeled |
| 14 | Metal shaft + conductive rubber (elastic) | Double-layer winding Oblique cut G: 28 μm | 216.3 mm/s (103%) | 16,000 prints | 5 μm | Not peeled |
| 15 | Metal shaft + conductive coating (inelastic) | Double-layer winding Oblique cut G: 25 μm | 210 mm/s (100%) | 9,000 prints | 11 μm | Not peeled |

TABLE 5-continued (Circumferential speed of photosensitive member: 210 mm/s)

| No. | Charge roller | Gap member | Circumferential speed | Number of prints at the time when print error occurred | Thickness difference | Tape peeling |
|---|---|---|---|---|---|---|
| 16 | Metal shaft + conductive rubber (elastic) | Double-layer winding Oblique cut G: 28 μm | 210 mm/s (100%) | 9,100 prints | 11 μm | Not peeled |

As shown in Table 5, the number of prints at the time when a print error occurred was 18,000 prints in Experiment No. 11, 16,000 prints in Experiment No. 12, 17,000 prints in Experiment No. 13, 16,000 prints in Experiment No. 14, 9,000 prints in Experiment No. 15, and 9,100 prints in Experiment No. 16. Table 5 also shows the difference in thickness between the charged portion of the photosensitive member 2 and the portions thereof which came into contact the gap members 3*d* and 3*e* at the numbers of prints above. In Table 5, the difference in thickness was 3 μm in Experiment No. 11, 3 μm in Experiment No. 12, 4 μm in Experiment No. 13, 5 μm in Experiment No. 14, 11 μm in Experiment No. 15, and 11 μm in Experiment No. 16.

The tapes of the gap members 3*d* and 3*e* did not peel in any of Experiment Nos. 11 to 16.

The results shown in Table 5 demonstrated that the difference in thickness between the charged portion of the photosensitive member 2 and the portions thereof which come into contact the gap members 3*d* and 3*e* can be reduced in non-contact charging using a superimposed bias voltage containing DC and AC voltage components by rotating the photosensitive member 2 and the charge roller 3*a* at different circumferential speeds to perform excellent charging over an extended period of time. If the photosensitive member 2 and the charge roller 3*a* are rotated at different circumferential speeds, the gap members 3*d* and 3*e* wear the portions of the photosensitive member 2 which come into contact the gap members 3*d* and 3*e*. The thickness of the contact portions is thus decreased as the thickness of the charged portion is decreased with increasing number of prints. This allows for a reduction in the difference in thickness between the contact portions and the charged portion. The charge roller 3*a* can therefore maintain the charge gap G at a predetermined width or less. The above results thus confirmed that the life of the photosensitive member 2 can be prolonged by rotating the photosensitive member 2 and the charge roller 3*a* at different circumferential speeds.

As described above, a charge roller according to an embodiment of the invention has gap members formed of tape-shaped films wounded around both ends thereof and defines a predetermined charge gap between the gap members and an image-bearing member to charge the image-bearing member without contact. This charge roller can be suitably used for image-forming apparatuses including electrophotographic apparatuses such as electrostatic copiers, printers, and facsimiles.

The entire disclosure of Japanese Patent Application No. 2005-310809, filed Oct. 26, 2005 is expressly incorporated by reference herein.

What is claimed is:

1. A charge roller comprising:

a core;

a resistive layer disposed on a circumferential surface of the core to charge an image-bearing member without contact; and gap members formed of tape-shaped films fixed to both ends of the charge roller by winding each of the films in a direction opposite a rotational direction of the charge roller in use and perpendicular to the axial direction thereof to form n layers (wherein n≧2) extending in the axial direction at every position in the circumferential direction of the charge roller, the gap members being pressed against a circumferential surface of an image-bearing member to define a charge gap between the image-bearing member and the charge roller, wherein the core has annular grooves at both ends thereof;

the resistive layer is disposed on a portion of the core between the annular grooves and in the annular grooves; and the gap members are fixed to portions of the circumferential surface of the core between the annular grooves and the ends of the core.

2. The charge roller according to claim 1, wherein one side of each of the films protrudes to the adjacent annular groove; and the other side of the film protrudes outward beyond the adjacent end surface of the core.

3. A method for producing the charge roller according to claim 1, comprising:

forming the annular grooves at both ends of the core;

covering with masks the portions of the circumferential surface of the core between the annual grooves and the ends of the core;

forming the resistive layer by applying a conductive coating material to the annual grooves and the portion of the core between the annular grooves while rotating the core;

removing the masks from the portions of the circumferential surface of the core between the annual grooves and the ends of the core; and forming the gap members by winding the films around the portions of the circumferential surface of the core between the annular grooves and the ends of the core in the direction opposite the rotational direction of the charge roller in use and perpendicular to the axial direction of the charge roller to form the n layers.

4. An image-forming apparatus comprising:

an image-bearing member on which an electrostatic latent image or a developer image is formed;

the charge roller according to claim 1, charging the image-bearing member without contact;

a writing unit that writes an electrostatic latent image on the image-bearing member;

a developing unit that develops the electrostatic latent image with a developer to form a developer image on the image-bearing member; and a transfer unit that transfers the developer image from the image-bearing member.

5. The image-forming apparatus according to claim 4, wherein the image-bearing member and the charge roller are rotated at different circumferential speeds.

6. A charge roller comprising:

a core;

a resistive layer disposed on a circumferential surface of the core to charge an image-bearing member without contact; and gap members formed of tape-shaped films fixed to both ends of the charge roller by winding each of the films in a direction opposite a rotational direction of the charge roller in use and perpendicular to the axial direction thereof to form n layers (wherein n≧2) extending in the axial direction at every position in the circumferential direction of the charge roller, the gap members being pressed against a circumferential surface of an image-hearing member to define a charge gap between the image-bearing member and the charge roller, wherein the resistive layer includes thinner portions at both ends of the core and a thicker portion between the ends of the core; and the gap members are fixed to the thinner portions of the resistive layer.

7. A method for producing the charge roller according to claim 6, comprising:

covering both end portions of the circumferential surface of the core with masks;

forming the thicker portion of the resistive layer by applying a conductive coating material to a portion between the end portions of the circumferential surface of the core to a predetermined thickness while rotating the core;

removing the masks from the end portions of the circumferential surface of the core;

forming the thinner portions of the resistive layer by applying the conductive coating material to both ends of the core to a thickness smaller than that of the thicker portion; and forming the gap members by winding the films around the thinner portions of the resistive layer in the direction opposite the rotational direction of the charge roller in use and perpendicular to the axial direction of the charge roller to form the n layers.

8. A charge roller comprising:

a core;

a resistive layer disposed on a circumferential surface of the core to charge an image-bearing member without contact; and gap members formed of tape-shaped films fixed to both ends of the charge roller by winding each of the films in a direction opposite a rotational direction of the charge roller in use and perpendicular to the axial direction thereof to form n layers (wherein n≧2) extending in the axial direction at every position in the circumferential direction of the charge roller, the gap members being pressed against a circumferential surface of an image-bearing member to define a charge gap between the image-bearing member and the charge roller, wherein the core includes small-diameter portions at both ends thereof and a large-diameter portion between the ends thereof;

the resistive layer is formed on circumferential surfaces of the small-diameter portions and the large-diameter portion so as to have a substantially uniform thickness; and the gap members are fixed to portions of the resistive layer which cover the small-diameter portions of the core.

9. A method for producing the charge roller according to claim 8, comprising:

forming the resistive layer by applying a conductive coating material to the small-diameter and large-diameter portions of the core to a predetermined thickness while rotating the core; and forming the gap members by winding the films around the portions of the resistive layer which cover the small-diameter portions of the core in the direction opposite the rotational direction of the charge roller in use and perpendicular to the axial direction of the charge roller to form the n layers.

* * * * *